US009285195B1

(12) United States Patent
Palomaki et al.

(10) Patent No.: US 9,285,195 B1
(45) Date of Patent: Mar. 15, 2016

(54) COMPRESSIBLE ARCHERY NOCK

(71) Applicant: Easton Technical Products, Inc., Salt Lake City, UT (US)

(72) Inventors: Teddy D. Palomaki, Park City, UT (US); Kenny R. Giles, West Valley City, UT (US)

(73) Assignee: EASTON TECHNICAL PRODUCTS, INC., Salt Lake City, UT (US)

( * ) Notice: Subject to any disclaimer, the term of this patent is extended or adjusted under 35 U.S.C. 154(b) by 0 days.

(21) Appl. No.: 14/582,416

(22) Filed: Dec. 24, 2014

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS

| | | | | |
|---|---|---|---|---|
| 4,645,211 | A * | 2/1987 | Beiter | 473/578 |
| 8,257,208 | B2 * | 9/2012 | Harding | 473/578 |
| 8,622,855 | B2 * | 1/2014 | Bednar et al. | 473/578 |
| 2013/0267359 | A1 * | 10/2013 | Pedersen | 473/570 |
| 2014/0187362 | A1 * | 7/2014 | Pedersen et al. | 473/570 |
| 2015/0105191 | A1 * | 4/2015 | Pedersen et al. | 473/570 |

* cited by examiner

*Primary Examiner* — John Ricci
(74) *Attorney, Agent, or Firm* — Holland & Hart

(57) ABSTRACT

A projectile, either a crossbow bolt or an arrow, having a compressible nock. The projectile has a shaft having a front end portion and a rear end portion, an arrow point positioned on the front end portion of the shaft, multiple vanes extending from the shaft between the front end portion and the rear end portion, and a nock at least partially extending from the rear end portion. The nock has a compressible end portion that is compressible toward the shaft to maintain the nock on a bowstring when the bolt is launched. In an example case, the rear end portion is flat at its rear surface and, when the bolt is launched from a crossbow, the bowstring deforms the compressible end portion of the nock to form a groove or notch in which the bowstring is seated while the bolt is launched.

32 Claims, 16 Drawing Sheets

COMPRESSIBLE ARCHERY NOCK

TECHNICAL FIELD

The present disclosure generally relates to nocks for bolts and arrows used in archery bows and crossbows and particularly relates to a flexible nock for use in those devices.

BACKGROUND

Archers and crossbow shooters constantly seek ways to improve the accuracy and reliability of their bows and crossbows. One way to improve accuracy and reliability is to control the orientation of the projectile (e.g., an arrow or bolt) when it is launched from the bow or crossbow. In an archery bow (e.g., compound bow or recurve bow), the fletchings or vanes of the arrow should be oriented so that they have minimal interference with the cables, arrow rest, and riser as the arrow is launched. Similarly, in a crossbow the fletchings or vanes of the bolt must be properly oriented to avoid contact with the rails as the bolt is launched.

The nock at the trailing end of an arrow or bolt may also affect the reliability of the bow. For example, it is possible to dry fire (i.e., release the string without launching an arrow) the bow or crossbow if the bowstring is able to slip laterally past the trailing end of the arrow and move along the shaft of the projectile when the bowstring is released. When a dry fire occurs, the energy that otherwise would be transmitted to the projectile is absorbed by the bow or crossbow, which can have undesirable consequences.

The trailing end of an arrow or bolt most often includes a nock to help orient the projectile relative to the bow or crossbow and to keep the bowstring secured to the projectile until it reaches the proper release position. A half-moon nock, for example, may be attached to a bolt so that when a crossbow's bowstring extends across and within the half-moon shaped groove of the nock, an index vane of the bolt is properly oriented between rails of the crossbow. When the bowstring is released, the C-shaped or V-shaped groove at the end of the nock keeps the bowstring aligned directly with the longitudinal axis of the shaft of the bolt. The force of the bowstring is therefore efficiently and properly transferred to the projectile.

However, some of these types of nocks have drawbacks. Nocks and vanes are typically secured to the bolt shafts as part of an assembly process performed by manufacturers or by end-users. These processes are susceptible to imperfections and errors that can affect the nock's orientation and performance. If a vane or half-moon nock is not attached correctly to a bolt shaft, the index vane may not be oriented to the bowstring properly when loaded into a crossbow. As such, the vane may undesirably slide against the rails when the bowstring is released to launch the bolt or the crossbow bowstring will not seat and engage the misaligned nock correctly. A misaligned nock may cause the bolt to be pushed to one side during the launch process, thereby affecting the bolt's flight. Additionally, even if the nock is properly attached to the shaft, the archer may load the bolt incorrectly (e.g., using the wrong vane as an index vane) and may thereby prevent proper interaction between the nock and the bowstring.

Some nock makers have engineered nocks with multiple groove shapes in order to reduce the chance that a bolt is improperly loaded into the crossbow. These nocks are nevertheless still vulnerable to assembly misalignment by the manufacturer or end user and may not provide enough grip to keep the bowstring seated against the bolt. There is therefore a need for improvements to existing archery nocks.

SUMMARY

One aspect of the present disclosure relates to a crossbow bolt that has a compressible nock. The bolt may include a shaft having a front end portion and a rear end portion. An arrow point may be positioned on the front end portion of the shaft, a plurality of vanes may extend from the shaft between the front end portion and the rear end portion, and a nock may at least partially extend from the rear end portion of the shaft. The nock may comprise a compressible end portion that is compressible toward the shaft to maintain the nock on a bowstring when launching the bolt.

The nock may comprise a main body portion separate from the compressible end portion, and the main body portion may be attachable to the rear end portion of the shaft. The main body portion may have a rear end surface, and the compressible end portion may be attached to the rear end surface of the main body portion. The main body portion may further comprise a groove or hole into which the compressible end portion may be secured. The nock may comprise a main body portion separate from the compressible end portion, wherein the main body portion is attachable to the rear end portion of the shaft, and wherein the compressible end portion of the nock is attached to the main body portion by an interference fit or a friction fit.

In another embodiment, the compressible end portion may comprise a rear surface that is substantially flat when the compressible end portion is uncompressed and is contoured when the compressible end portion is compressed between a bowstring and the shaft. Any one of the plurality of vanes may be usable as an index vane while a bowstring is seated in the nock. The compressible end portion may comprise a rear surface that is compressible into a half-moon shape. The compressible end portion may be compressible around a bowstring as a result of contact with the compressible end portion of the bowstring. The compressible end portion may have an end diameter substantially equal to a shaft diameter of the shaft.

In some embodiments the nock comprises a front end portion inserted into the shaft, and the front end portion and the compressible end portion are a single piece. A structural reinforcing member may also be positioned forward of the compressible end portion.

Another aspect of the present disclosure is directed to a flexible nock for an archery arrow or bolt. The flexible nock may comprise a front end portion configured to be inserted into an arrow or bolt, the front end portion having a longitudinal axis. The nock may also comprise a rear end portion configured to extend rearward from the arrow or bolt upon insertion of the front end portion into the arrow or bolt, wherein the rear end portion is configured to at least partially deform toward the front end portion upon application of a force against the rear end portion that is substantially parallel to the longitudinal axis of the front end portion.

In some arrangements, the front end portion is a separate part from the rear end portion, and the front end portion is substantially rigid. The front end portion may further comprise an internal void, and the rear end portion may extend at least partially into the internal void. The internal void may comprise a narrow portion and a broader portion, and the rear end portion may be retained within the internal void through the narrow and broader portions. The rear end portion may extend at least partially into the front end portion. In some embodiments, a rear surface of the front end portion may comprise a hole or a groove.

The rear end portion of the flexible nock may have a Shore A hardness within a range of about 20 to about 100, and in some cases, within a range of about 65 to about 80. The rear end portion may be configured to grip a bowstring upon the bowstring applying pressure to the rear end portion toward the front end portion. A rear surface of the rear end portion may be configured to at least partially deform into an arc upon application of a force by a bowstring. This arc may have a radius substantially equal to a radius of the bowstring. The front end portion and the rear end portion may in some cases be a unitary block of a compressible material.

In another aspect, a method of nocking an archery arrow or bolt to a bowstring is provided. The method may comprise providing an arrow or bolt having a compressible rear surface and a bow or crossbow having a bowstring, loading the arrow or bolt in the bow or crossbow by positioning the arrow or bolt forward of the bowstring, wherein the compressible rear surface is configured to contact the bowstring upon release, and applying a force against the compressible rear surface of the arrow or bolt with the bowstring, wherein the force compresses the compressible rear surface to form a groove in the compressible rear surface where the compressible rear surface contacts the bowstring.

In a method of using the compressible archery nock, a groove may dynamically grip a surface of the bowstring upon release of the bowstring. The arrow or bolt may further comprise a plurality of vanes, wherein the groove is formed in the compressible rear surface irrespective of the rotated position of the plurality of vanes with respect to the bow or crossbow. The groove is positioned between two ridges extending parallel to the bowstring. The bowstring may comprise a bowstring radius and the bowstring compresses the compressible rear surface to a depth less than the bowstring radius. The bowstring may also compress the compressible rear surface to form an at least temporarily asymmetric groove.

The above summary of the present invention is not intended to describe each embodiment or every implementation of the present invention. The Figures and the detailed description that follow more particularly exemplify a preferred embodiment.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
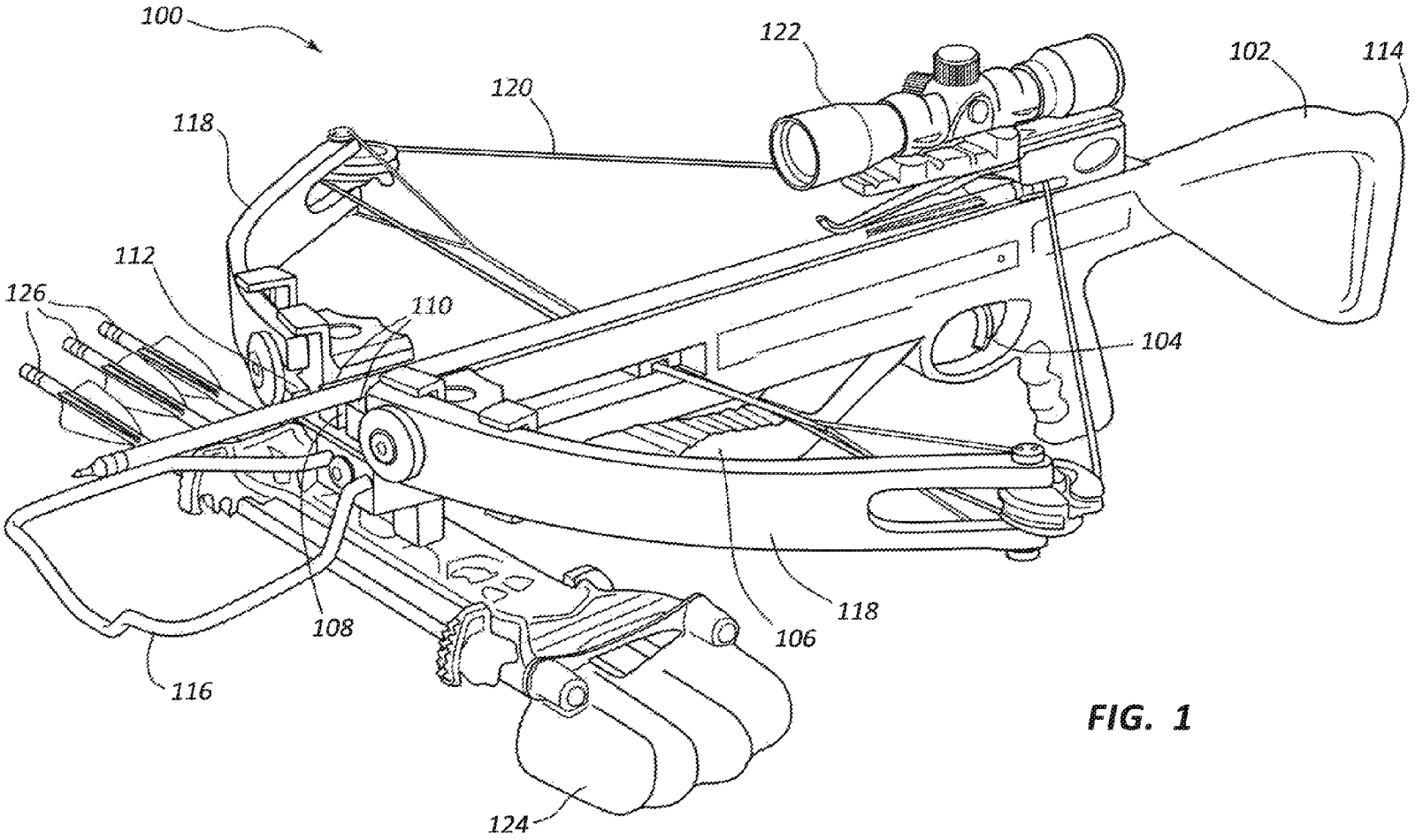
FIG. 1 is a view of a crossbow and bolts or arrow according to an embodiment of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to an improved archery nock that may receive a bowstring without a need for precise rotational alignment of the nock relative to the bowstring or relative to the shaft or vanes of the projectile. In one embodiment, a projectile (i.e., a crossbow bolt or arrow) may comprise a nock attached to its rear or trailing end portion. A portion of the nock may be compressible relative to a longitudinal axis of the shaft or nock (i.e., compressible axially relative to a longitudinal axis of the projectile shaft). Because the nock is at least partially compressible, a bowstring pressing against the compressible end portion may dynamically form a groove, notch, indentation, or other deformed shape that is substantially aligned with the bowstring and sized to receive the outer surface of the bowstring at a contact angle and for a wide variety of bowstring shapes and sizes. Accordingly, the nock may mold itself dynamically to conform to the bowstring shape (e.g., the string geometry), at least when under launch loads. The materials and shapes used for the compressible end portion of the nock may also increase friction between the nock and the bowstring to help keep the bowstring seated against the nock until the bolt is released from the crossbow.

The nock may have multiple portions, such as, for example, a main body portion and a compressible end portion. The main body portion may be attached to the projectile shaft, and the compressible end portion may be attached to the main body portion. Thus, the main body portion may be more rigid than the compressible end portion and may provide a secure fit between the main body and the compressible end portion. In some embodiments, the compressible end portion may be directly attachable to the shaft.

The main body portion of a nock may have a longitudinal bore, and the compressible end portion may be overmolded or otherwise manufactured to fit within the bore to limit unintentional removal of the compressible end portion from the main body portion. For example, the compressible end portion may be secured by an interference fit or friction fit within the bore. The bore may further have a plurality of different inner widths or diameters, and the compressible end portion may comprise a stem or plug that is molded or inserted into the inner widths or diameters in a manner interfering with withdrawal of the stem or plug from the bore.

In some arrangements, the compressible end portion may be secured to the main body portion by an adhesive. A chemical bond may be established by overmolding creating an adhesive connection between the compressible end portion and the main body portion. Alternatively or additionally, an adhesive may also be added as a secondary operation between a compressible end portion and a main body portion. The rear end surface of the main body portion may include a flattened or textured portion to facilitate attachment of the compressible end portion to the main body portion by adhesion or molding. In some cases, this rear end surface may be a flat surface in which a roughened up or textured surface, grooves, depressions, bumps, or holes, may be configured and positioned in a manner that increases the available surface of area or the friction relative to the back surface for adhesion of the compressible end portion to the main body portion.

When a bowstring impinges against or strikes the compressible end portion of the nock, the compressible end portion may yield and compress in the direction of bowstring movement, such as in an axial direction relative to the longitudinal axis of the projectile being launched. In other words, the compressible end portion compresses in an axial direction that coincides with the longitudinal axis of the projectile. For a bowstring having a substantially circular cross-section, this means that the compressible end portion may depress most deeply in an axial direction toward the projectile shaft (i.e., in a direction perpendicular to the initial point of contact of the bowstring against the compressible end portion) and may form an arc in the compressible end portion having a radius substantially equal to the radius of the bowstring (e.g., when viewed in a cross-sectional plane perpendicular to the length of the bowstring). See FIG. 7A. This depression in the compressible end portion may be alternatively referred to as a groove, notch, trough, channel, or trench in the nock. Portions of the compressible end portion that surround the sides of the bowstring (i.e., "lateral" sides, sections, or regions, which are defined as portions of the compressible end of the nock on each side of the bowstring irrespective of the bowstring being horizontal (as with a crossbow) or vertical (as with an archery bow)) relative to the direction of compression may remain relatively thicker than the compressed section. That is, the thicker portions of the compressible end portion may extend toward or wrap slightly around the sides of the bowstring in a pincer-like shape, thereby keeping the bowstring seated in the compressed groove.

Additionally, because the compressible end portion has a width, the bowstring may depress the compressible end portion to different depths across the length of the depression. If the compressible end portion has a rear surface that is substantially flat when not engaged or in contact with the bowstring, for example, the bowstring may bear against and compress the compressible end portion at end areas 707 as compared to a central area 709 (see FIG. 7E) of the rear surface due to curvature in the bowstring. Thus, the shape of the deformation in the compressible end portion may differ along the rear surface of the compressible end portion in relation to where it contacts the bowstring.

By selecting an appropriate material and hardness of the compressible end portion, the depth of the depression may be beneficially configured to deform sufficiently to retain the bowstring in the depression while the bolt is launched. Simultaneously, the depression may provide friction against the bowstring to resist movement of the bowstring out of the depression, and allow the compressible end portion to resiliently rebound to its original shape after release. The material selected for the compressible end portion may be chosen based on one or more of the following criteria: its hardness or flexibility, its compression strength, its tear strength, its abrasion resistance, its flex fatigue resistance, its ozone resistance, its ultraviolet (UV) resistance, the variation of its properties over a range of expected operating temperatures, its compatibility with the materials used in a nock main body portion or base portion, its ability to adhere to the base portion, its cost, its ease of processing, or its ease of coloring. Compressible end portions may comprise a thermoplastic elastomer (TPE) having a hardness within a range of about 20 to about 100 on the Shore A scale, with preference for materials within a range of about 65 to about 80 on the Shore A scale. For example, some of these TPE materials are commercially available from PolyOne™ Corporation under the names Dynaflex™ D3226-1000-03, Dynaflex™ D3202-1000-03, Dynaflex™ D3204-1000-03, Versaflex™ OM 1040X-1, and Versaflex™ OM 6240-1. Other options may include the Thermoplastic Vulcanizates (TPV) class of TPEs from Exxon Mobile™ Corporation identified as Santoprene™ 8211-25, Santoprene™ 8211-35, Santoprene™ 101-50, Santoprene™ 101-64, Santoprene™ 101-87, and Santoprene™ 111-45. Another material option may include Urethane from Lubrizol Advanced Materials, Inc. such as Estane® Urethane 2103-70A TPU, Estane® Urethane 2103-65D TPU, or Estane® Urethane 11T85 TPU.

Materials for the main body portion or base portion of the nock may comprise materials generally known in the field of bolt and arrow nocks, such as, for example, nylon (with glass fill percentages from about 0% to about 50%), polycarbonate, acrylonitrile butadiene styrene (ABS), and butyrate.

In some embodiments, the compressible end portion of the nock may absorb some of the kinetic energy of the bowstring when it compresses, but it may then restore a portion of that energy as the compressible end portion returns to its original shape by rebounding against the bowstring as it escapes contact with the bowstring. A compressible nock with these properties may therefore at least partially compensate for energy losses inherent in a compressible system.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments. Although some descriptions herein are specifically directed toward bolts and crossbow equipment, it will be understood by those having ordinary skill in the art that principles and elements of the disclosure may apply to other types of archery equipment, such as, for example, nocks for arrows used in compound bows, traditional bows, and recurve bows. As used herein, a "bolt" may be defined as an elongated projectile launched from a crossbow. Thus, a bolt may be synonymously referred to as a "crossbow arrow" or the like and is differentiated from a bolt that would be used as a fastener (e.g., a threaded bolt attachable to a threaded nut).

Turning now to the figures in detail, FIG. 1 illustrates a crossbow 100 according to an embodiment of the present disclosure. The crossbow 100 may comprise a stock 102, a trigger assembly 104, a handgrip 106, a flight groove 108, and rails 110 on each side of the flight groove 108. The crossbow 100 may have a front end 112 and a rear end 114. A foot stirrup 116 and a plurality of limbs 118 may be attached at the front end 112. A bowstring 120 may extend across the limbs 118 and may move along the stock 102 adjacent to the rails 110. The crossbow 100 may also comprise sights 122, a quiver 124 to hold bolts 126, and other accessories.

Figure 2:
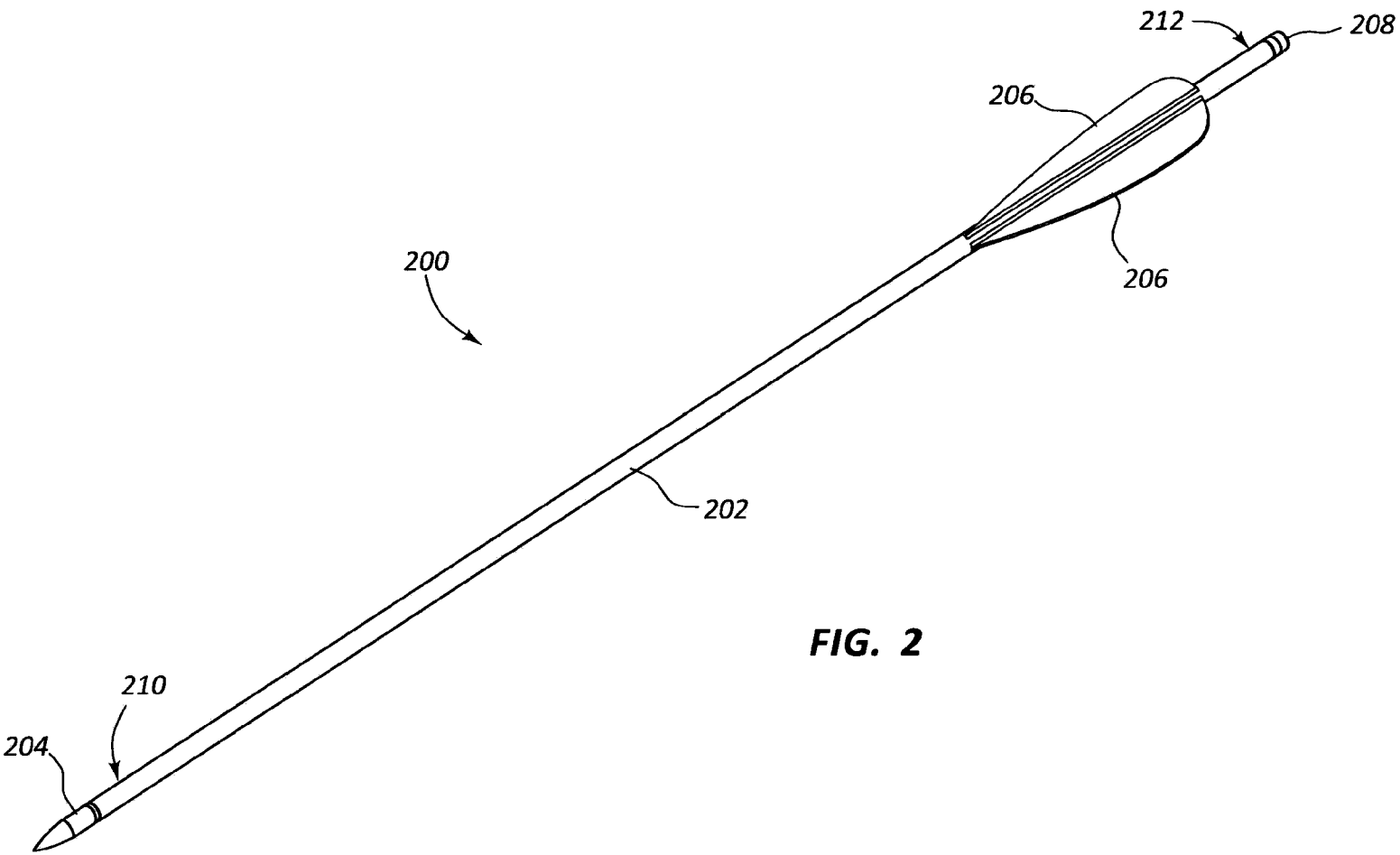
FIG. 2 shows a view of a crossbow bolt or arrow according to an embodiment of the present disclosure.
Figure 3:
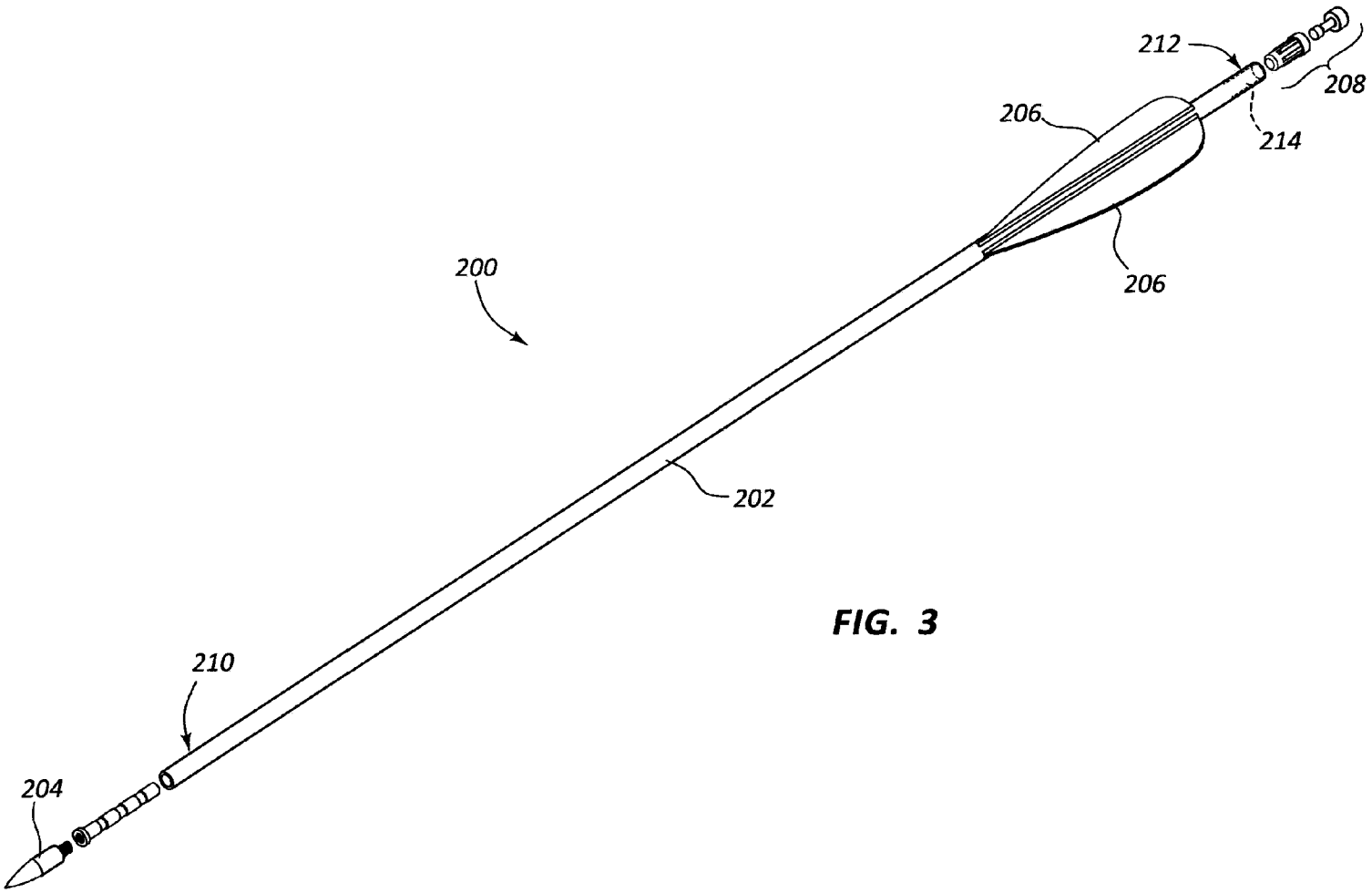
FIG. 3 shows an exploded view of the crossbow bolt or arrow of FIG. 2.

FIGS. 2 and 3 show a projectile (e.g., a bolt or an arrow) 200 according to an embodiment of the present disclosure. The bolt 200 may comprise an elongated shaft 202, an arrow point 204, a plurality of vanes or fletchings 206, and a nock 208 insertable into an opening 214 in the shaft 202. A longitudinal axis may extend centrally along the elongated length of the shaft 202. The arrow point 204 may be referred to as being at a front end portion 210 of the shaft 202, and the nock 208 may be referred to as being at a rear end portion 212 of the shaft 202. FIG. 3 illustrates an exploded view of the bolt 200 of FIG. 2, showing that the arrow point 204, vanes 206, and nock 208 may be separate pieces assembled to construct the bolt 200. In other embodiments, the arrow point 204, vanes 206, and/or nock 208 may be integrally formed with the shaft 202 to form a single piece.

Bolts having the compressible nock of the present disclosure may be shot from the crossbow 100 by cocking the crossbow 100 (thereby flexing the limbs 118 rearward and positioning the center of the bowstring 120 toward the rear end 114 of the crossbow 100), loading a bolt onto the rails 110 with an index vane within the flight groove 108, and pulling the trigger of the trigger assembly 104. The trigger causes the bowstring 120 to be released, thereby allowing the tension in the limbs 118 to forcefully straighten the bowstring 120 and move the center of the bowstring 120 toward the front end 112 of the crossbow 100. This movement of the bowstring 120 causes the bowstring to push the bolt along the rails 110 while it contacts the nock and, consequently, launch the bolt forward.

Figure 4:
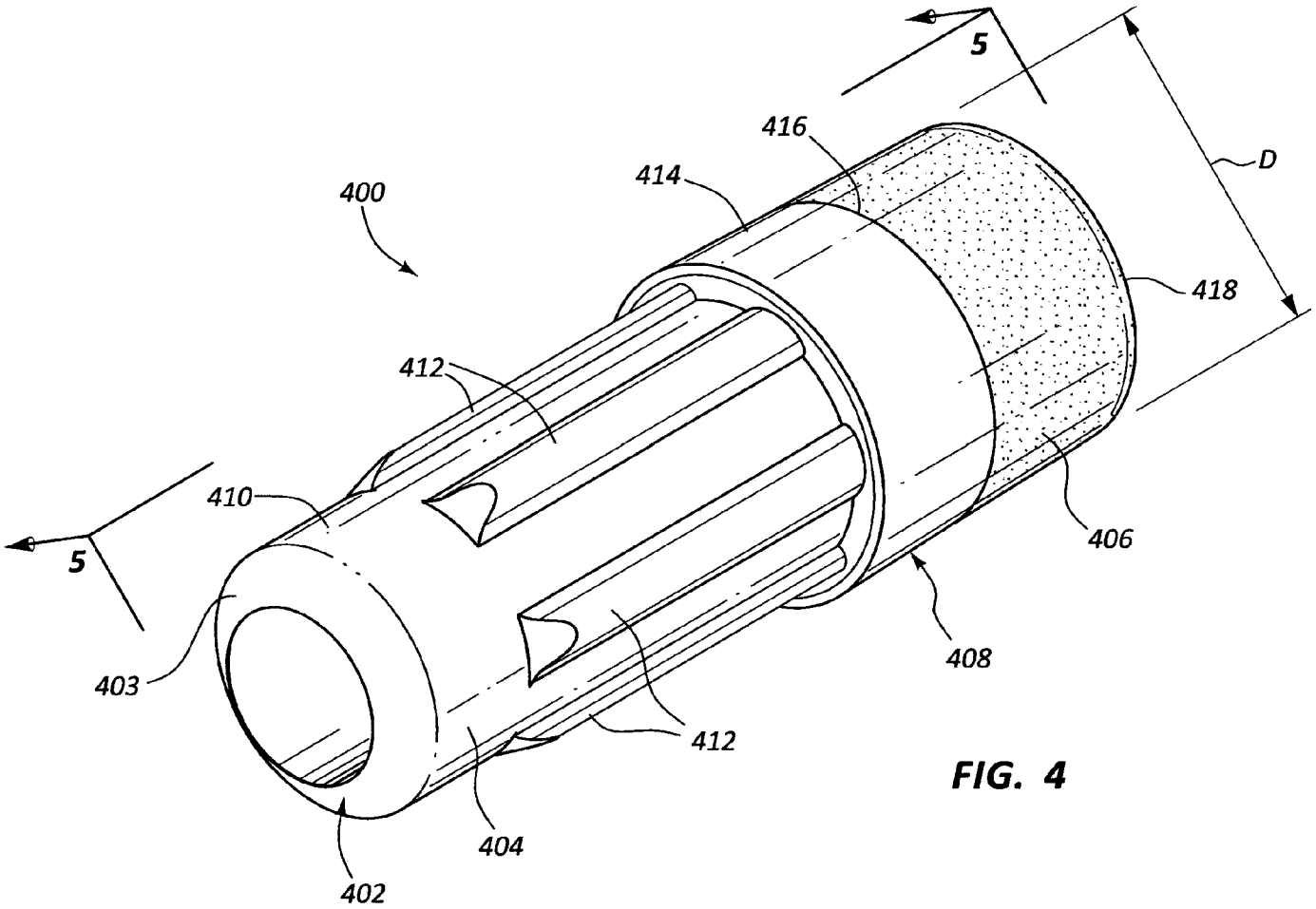
FIG. 4 is an isometric view of a nock according to an embodiment of the present disclosure.

FIG. 4 shows an isometric view of a compressible nock 400 according to an embodiment of the present disclosure. The nock 400 may be attachable to a shaft of a bolt (e.g., bolt 200) by insertion of a front end 402 of a main body portion 404 of the nock 400 into an opening 214 in a rear end portion 212 of a shaft 202 of the bolt 200. For example, the nock 400 may be inserted into the bolt 200 to cover a length $L_1$ (see FIG. 5) of the nock 400. The main body portion 404 of the nock 400 may be attached to a compressible end portion 406 (i.e., a flexible member) that extends from a rear end 408 of the main body portion 404.

Between the front end 402 and rear end 408, the main body portion 404 may comprise a substantially cylindrical shaped portion 410 (see FIG. 4) from which a plurality of ridges 412 may extend radially outward. The ridges 412 may be sized and configured to allow the nock 400 to be seated within the rear end of a bolt using a pressure/friction fit. The front end 402 of the nock 400 may have a tapered or rounded leading surface 403 that also helps to ease insertion of the nock 400 into the bolt.

The rear end 408 of the main body portion 404 may have an external portion 414 having a larger diameter than the cylindrical shaped portion 410. In some embodiments, the external portion 414 extends from the rear end of the bolt shaft external to the opening 214. The external portion 414 may be substantially cylindrical. It may also have substantially the same diameter as the bolt shaft to preserve or improve the aerodynamics and feel of the exterior of the bolt. The compressible end portion 406 of the nock 400 may extend from the main body portion 404 to a length $L_2$ (see FIG. 5) and may have a rear diameter D. In some embodiments, the length $L_2$ may be between about 0.150 inches and about 0.250 inches. In other embodiments, $L_2$ may be longer or shorter. The part of the compressible end portion 406 extending from the external portion 414 of the main body portion 404 may also have a substantially cylindrical shape with a flat rear surface 418. In some embodiments, the rear surface 418 may be curved or textured to improve grip when contacting a bowstring.

In one embodiment, the main body portion 404 may be a standard "flat-back" bolt nock known in the art. The standard "flat-back" main body portion 404 may thus be modified to further include the compressible end portion 406, such as by adhering a puck-shaped compressible end portion 406 to a rear surface 416 of the main body portion 404 or by modification of the surfaces and interior of the main body portion 404 (as discussed further in connection with FIGS. 5 and 8-10) and molding or attaching a compressible end portion 406 to the modified surfaces and/or interior.

Figure 5:
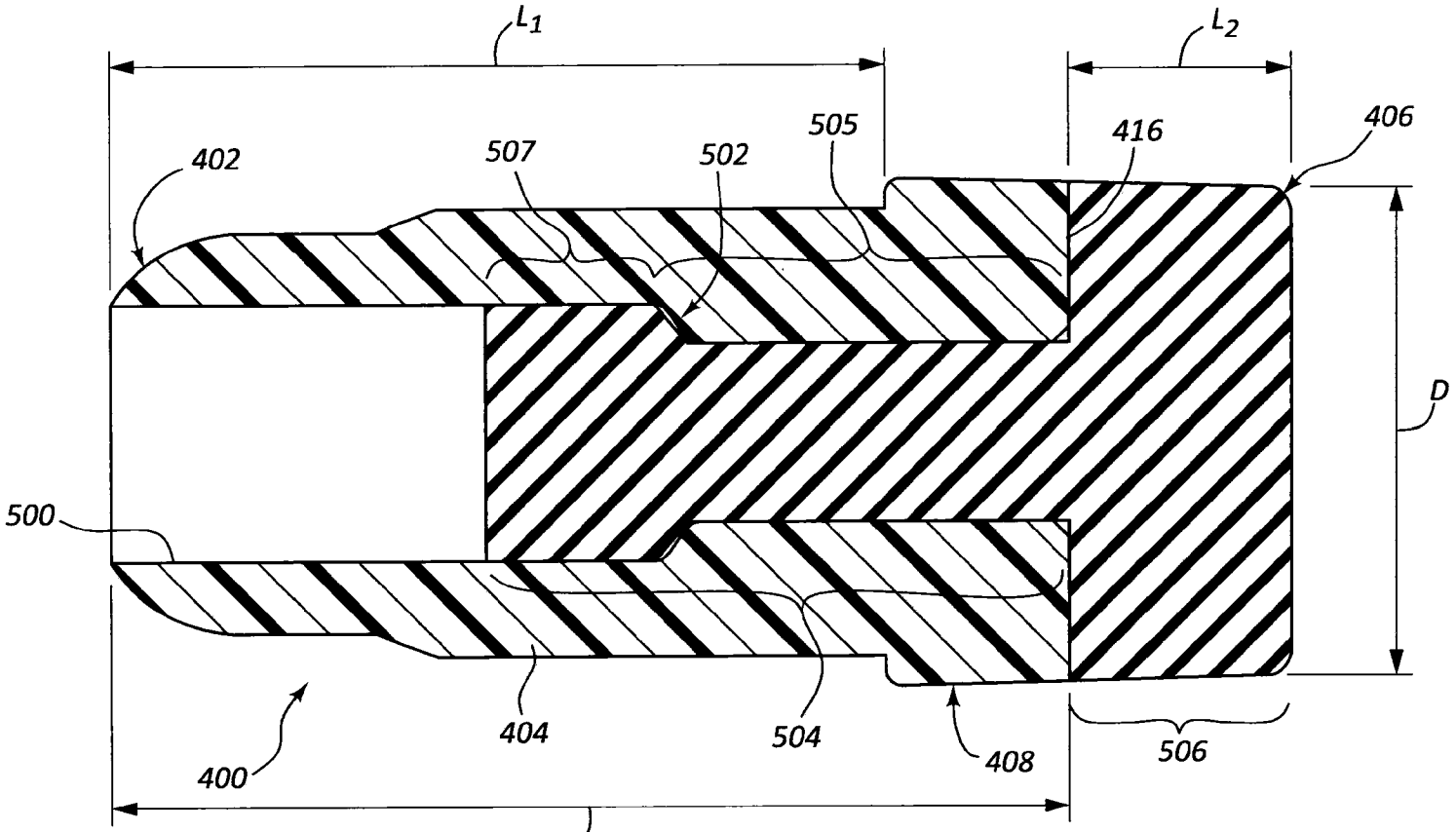
FIG. 5 is a side section view of the nock of FIG. 4 taken through section lines 5-5 in FIG. 4.

FIG. 5 illustrates that the nock 400 may comprise an internal cavity, bore, void, or hole within the main body portion 404. The bore 500 may extend partially or completely along the length $L_3$ of the main body portion 404. In FIG. 5, the bore 500 extends from the front end 402 through the rear surface 416. Portions of the bore 500 may have a greater diameter than others. For example, at the front end 402, the bore 500 may have a wider inner diameter than the diameter of the bore 500 at the rear end 408. The bore 500 may comprise a necked-down portion 502 where the diameter of the bore 500 narrows over a short distance. In some embodiments, the bore 500 may gradually narrow over a greater length of the main body portion 404, such as by forming a frusto-conical void within the main body portion 404. The bore 500 may be referred to as an internal void of the main body portion 404.

A narrowing bore 500 may be beneficial because it may allow an interference fit between the compressible end portion 406 and the main body portion 404. The compressible end portion 406 may have a stem 504 extending at least partially into the bore 500 from a rear portion of the bore 500 to a portion of the bore 500 that has a wider inner diameter toward the front end of the bore 500. For example, the stem 504 may comprise a narrower first section 505 and a wider second section 507, wherein the first section is positioned to the rear of the second section relative to the main body portion 404. The stem 504 may therefore resist removal of the compressible end portion 406 from the bore 500 if the compressible end portion 406 is pulled rearward relative to the main body portion 404.

The compressible end portion 406 may preferably be securely held by and attached to the main body portion 404. In some embodiments, the stem 504 may be integrally formed with the rest of the compressible end portion 406, and in some embodiments, the stem 504 may be attached to a rear block 506 of the compressible end portion 406. The stem 504 and rear block 506 may comprise the same material or different materials. In one embodiment, the compressible end portion 406 may be attached to the main body portion 404 by an overmold process wherein the stem 504 and rear block 506 are simultaneously formed around the main body portion 404 by adding compressible material to the mold (e.g., injection molding or polymer sintering). This may also provide or enhance adhesion of the compressible end portion 406 to the main body portion 404.

In another embodiment, the stem 504 may be inserted into the bore 500 after the main body portion 404 and compressible end portion 406 have been separately made. In this case, the stem 504 may beneficially have a slightly larger outer diameter than the bore 500 so that the stem 504 may be frictionally fit within the bore 500 upon insertion.

Figure 6:
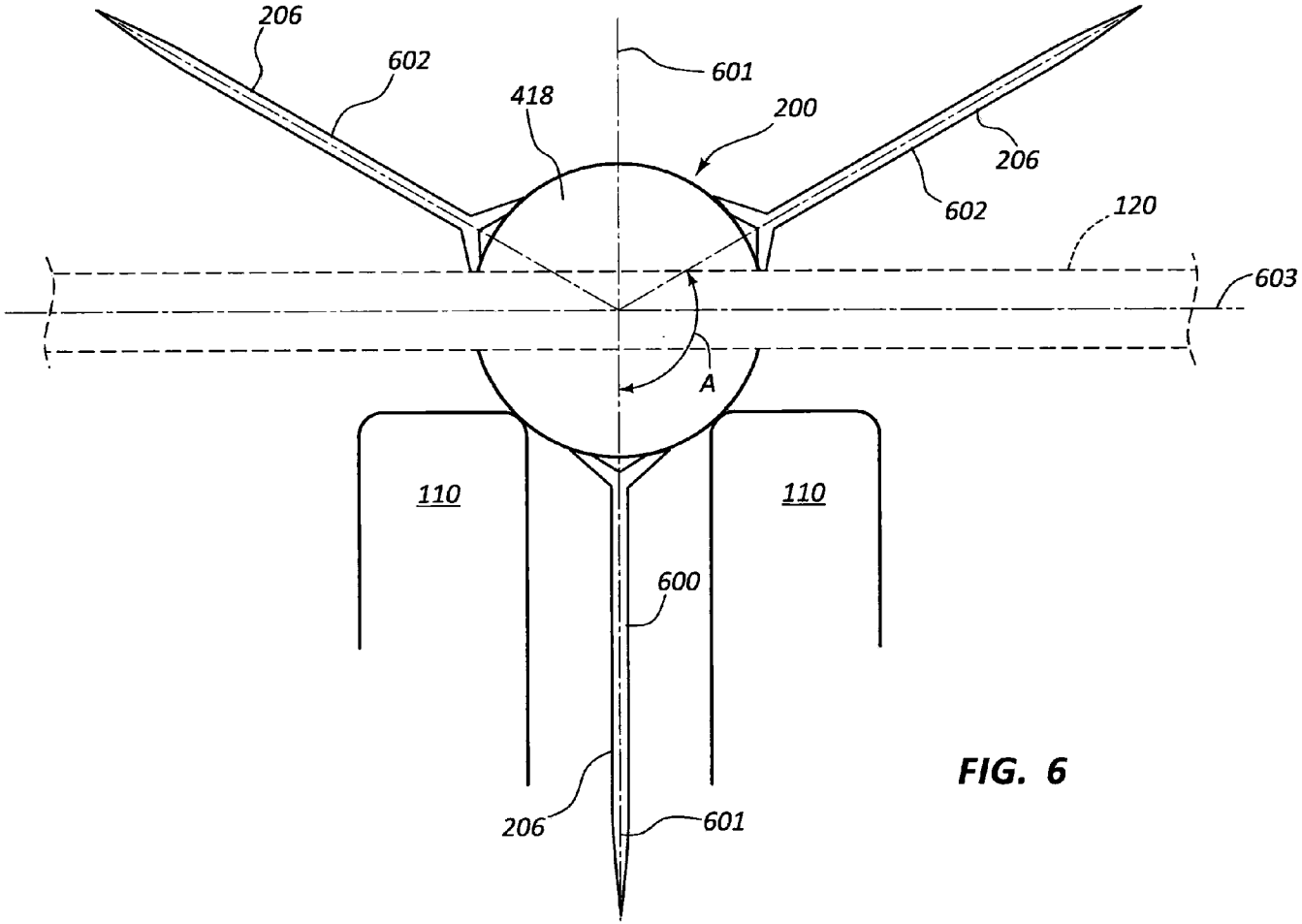
FIG. 6 is a rear end view of a bolt placed on rails of a crossbow according to an embodiment of the present disclosure.

FIG. 6 is a rear view of a bolt 200 being supported by rails 110 of a crossbow. The rear surface 418 of the compressible end portion 406 of the nock 400 of the bolt 200 is visible. Three vanes 206 extend from the bolt 200 at positions having 120 degrees of separation around the shaft of the bolt 200. An index vane 600 (i.e., cock vane) is positioned between the rails 110 along a vertical plane 601 that extends along the length of the longitudinal axis of the shaft of the bolt 200 and parallel to the rails 110. Two guide vanes 602 (i.e., hen vanes) extend away from the rails 110. A horizontal plane 603 is perpendicular to the vertical plane 601 and is generally parallel with the surfaces of the rails 110 that contact the bolt 200 and in-plane with a longitudinal axis of the shaft of the bolt 200.

In ideal conditions, the vanes 206, rails 110, and bowstring are all perfectly aligned relative to each other. The guide vanes 602 are positioned at an angle A of 120 degrees with respect to each other. The bowstring (e.g., bowstring 120) of the crossbow engages the rear surface 418 of the nock across the horizontal plane 603. In this position, the index vane 600 does not drag against the sides of the rails 110, so the flight of the bolt is unaffected by contact of the index vane 600 with the crossbow.

A typical bolt nock can hold the bowstring under ideal conditions because a groove is pre-formed in the rear surface of the nock (e.g., in a half-moon nock) that holds the bolt to the bowstring. The bowstring is held in the nock with the bolt at a particular orientation wherein the index vane 600 is ideally exactly within the vertical plane 601, which corresponds to a central position relative to the rails 110 on a crossbow. However, these conventional bolt nocks are less effective under non-ideal conditions. For example, if the groove in a conventional nock is not closely aligned with the horizontal plane 603, the vanes 206 may not be oriented properly relative to the rails 110 and the vertical plane 601. Also, if the bolt is loaded into the crossbow with the index vane extending in a wrong direction (e.g., with one of the other vanes—the guide vanes 602—between the rails 110), undesirable interference between the vanes and the rails will result and/or the nock will not properly hold the bowstring during launch.

In the embodiment of FIG. 6, however, the bowstring may engage the rear surface 418 at any angle when the bolt 200 is loaded with a vane 206 between the rails 110. Thus, any one of the plurality of vanes 206 may be used as the index vane 600 when the bowstring is seated in the nock since there is no pre-formed groove in the rear surface 418 that must be oriented properly relative to plane 603. A groove or depression in the rear surface 418 may be formed in the compressible end portion of the nock irrespective of the rotational position of the plurality of vanes 206 relative to the crossbow. Furthermore, the present embodiment may allow the bowstring to be displaced slightly above or below plane 603 (FIG. 6), yet may still securely engage the compressible nock during launch. A crossbow shooter using this embodiment may therefore load the crossbow more quickly and easily, without being required to focus on which vane is loaded between the rails 110. The nock may also secure a bolt to the bowstring in a wider range of relative rotational positions of the bolt and bowstring when compared with a conventional nock. For example, a greater range of angle A values may be acceptable for holding the bowstring 120 to the rear surface 418.

Figure 7A:
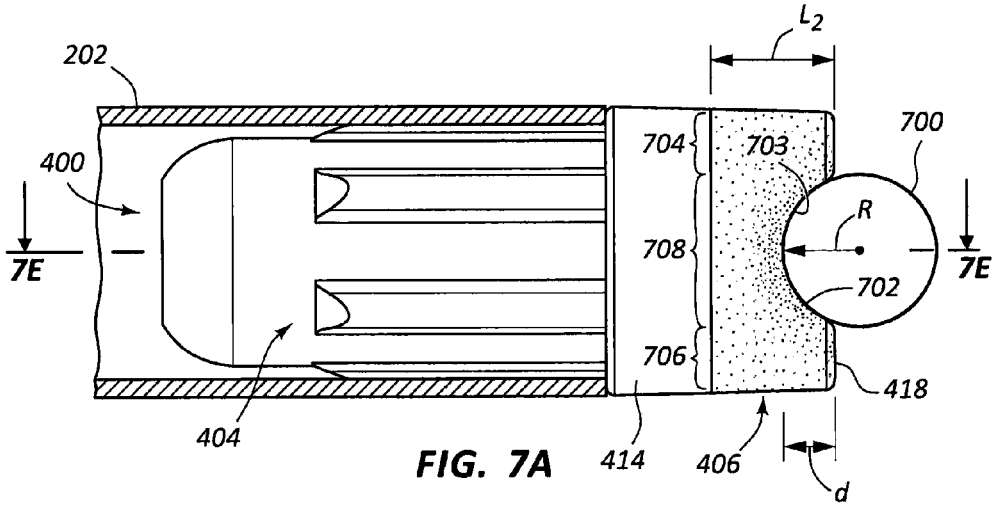
FIGS. 7A-7C are partial section views of the rear end of a bolt having embodiments of nocks according to embodiments of the present disclosure.
Figure 7B:
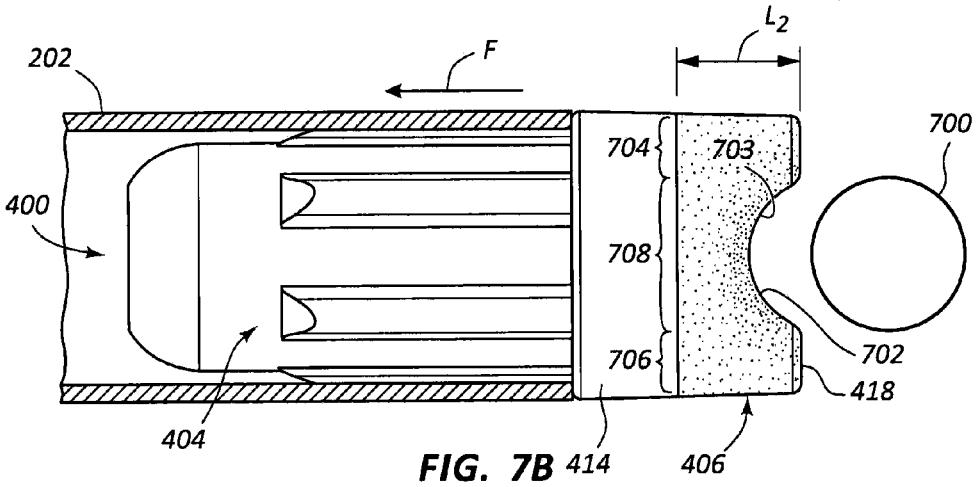
Figure 7C:
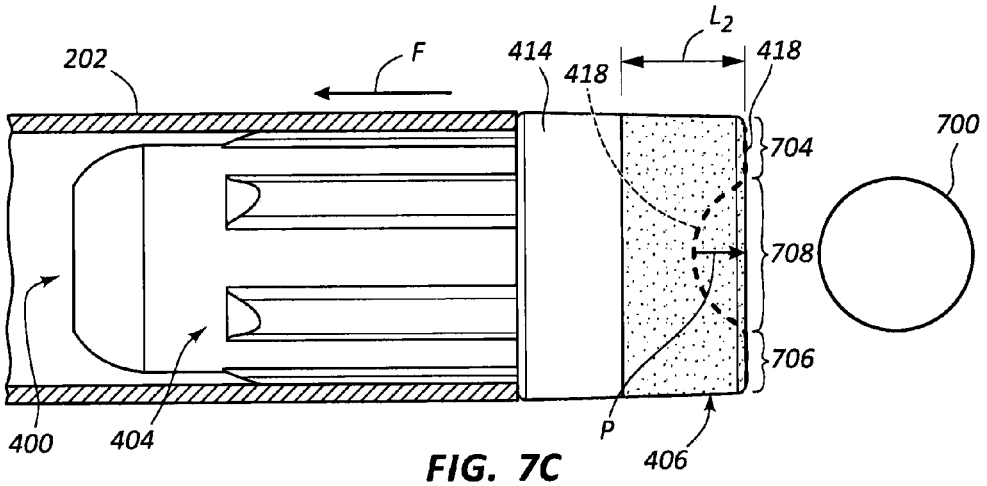

FIGS. 7A-7C illustrate examples of how a bowstring may interact with a compressible end portion of a nock of the present disclosure. The main body portion 404 of the nock 400 is installed within a shaft 202 of a bolt. The compressible end portion 406 is at the trailing end of the bolt and extends from the main body portion 404. In FIGS. 4 and 5, the nock 400 is shown at rest. The compressible end portion 406 has a generally planar rear surface 418 and may have a generally uniform thickness $L_2$ relative to the longitudinal axis of the nock 400 and bolt. The diameter D of the compressible end portion 406 is also generally equal to the diameter of the shaft 202 of the bolt and the external portion 414 of the main body portion 404. The arrangement of FIG. 4 may be the arrangement of the bolt from when the bolt is loaded into a crossbow until the trigger is pulled and the bowstring comes into contact with the rear surface 418.

FIG. 7A shows the shape of the compressible end portion 406 after being impacted by a bowstring 700 as it is loaded onto the crossbow or bow, just prior to launch. In some embodiments, the compressible end portion 406 may be flexible enough that the shape of the compressible end portion 406 may take the shape shown in FIG. 7A merely upon receiving the force applied by the bowstring 700, either as the bolt is loaded onto the crossbow or as the bow is drawn. For example, if the compressible end portion 406 is used in an arrow for a compound vertical bow, the tension in the bowstring may apply a force to the compressible end portion and deform the compressible end portion before the bowstring is released by the archer.

The bowstring 700 compresses the compressible end portion 406 such that the compressible end portion 406 no longer has a uniform thickness $L_2$. The impacted section 708 of the compressible end portion 406 is now thinner than the adjacent, lateral areas or sections 704, 706 of the compressible end portion 406 as the rear surface 418 yields under the force of the bowstring 700. The stippling of the compressible end portion 406 indicates concentrated compression in the central impacted section 708. The rear surface 418 of the compressible end portion 406 in this embodiment at least partially forms an arc 702 that has substantially the same radius R as the bowstring 700. FIG. 7A is a side view, so the arc 702 formed in the rear surface 418 may be a groove 703 extending across the diameter of the rear surface 418 in a direction following the length of the bowstring 700. The groove 703 may take the shape of the bowstring by deforming under a load applied by the bowstring. Thus, the compressible nock may receive the bowstring by forming the groove 703 due to the compressible, resilient, or pliant material of the compressible end portion 406.

When groove 703 is formed, the adjacent sections or lateral regions 704, 706 of the compressible end portion 406 may have greater thicknesses than the impacted section 708 of the compressible end portion 406. By extending at least partially around the sides of the bowstring 700, the compressible end portion 406 may grip or capture the bowstring 700. The lateral regions 704, 706 may have relatively less deformation than the impacted section 708, but some outward deformation may result in an increased diameter of the compressible end portion 406. These lateral or adjacent sections 704, 706 may form ridges that have lengths extending parallel to the bowstring 700. In some embodiments, the compressible end portion 406 of the nock 400 may be referred to as taking on a half moon shape, crescent shape, C-shape, or contoured shape after being deformed from a flat shape, planar shape, or non-contoured shape. While the bowstring 700 is seated in the groove 703, friction against the groove 703 and interference with the lateral sections 704, 706 may help keep the bowstring 700 from unexpectedly sliding out of the groove 703 during launch. To increase friction of the rear surface, a textured, ribbed, cross-hatched, or other roughed up surface may be provided on the rear surface of the end portion 406.

The embodiment shown in FIG. 7A illustrates a bowstring 700 that compresses the compressible end portion 406 to a depth d which is less than the radius R of the bowstring 700. Thus, the compressible end portion 406 at least partially deforms toward the nock main body portion 404 upon application of a force by the bowstring 700 in an axial direction that coincides with the longitudinal axis of the projectile. In some embodiments, the depth d may be equal to or greater than the radius R. The depth d may be affected by the acceleration, velocity, and physical characteristics (e.g., hardness and radius) of the bowstring 700, the physical characteristics of the compressible end portion 406 (e.g., its hardness and elasticity), and the physical characteristics of the projectile in general (e.g., its mass). Thus, while in FIG. 7A the groove 703 does not extend to or past the central axis of the bowstring 700, in some embodiments the rear surface 418 may extend up to or beyond the central axis of the bowstring 700 while the bowstring 700 is seated in the groove 703.

In some configurations the size of each of the lateral sections 704, 706 may differ. For example, the thickness of one of the lateral sections 704, 706 may be different than the other because the bowstring 700 may impact the compressible end portion 406 closer to one side of the rear surface 418 than the other. Thus, the different sizes of the lateral sections 704, 706 may result in an at least temporarily asymmetric bolt nock after or while the bowstring 700 is in contact with the nock 400. If the bolt is shot a second time, the compressible end portion 406 may not be asymmetric during a second launch due to the bowstring 700 impacting and shaping a different area on the rear surface 418 after the rear surface 418 is able to return to its normal, flat shape.

FIGS. 7B and 7C illustrate two embodiments of the projectile as it is released from the bowstring 700. Arrow F indicates the direction of flight of the projectile away from the bowstring 700. In the embodiment of FIG. 7B, the compressible end portion 406 of the nock 400 is plastically deformed by the bowstring, so the groove 703 remains in the compressible end portion 406 after it is removed from the bowstring 700. Alternatively, the materials used in the compressible end portion 406 may be elastically deformed, but may return to the original shape slowly.

In the embodiment of FIG. 7C, the compressible end portion 406 resiliently and quickly returns to its original shape after the projectile is released from the bowstring 700. Thus, the rear surface 418 remains flat except when in a loaded condition. As the compressible end portion 406 rebounds to this shape, potential energy stored by the compressible end portion 406 may act against the bowstring 700 in the direction of arrow P, thereby further accelerating the projectile away from the bowstring 700 as it is launched from the bowstring 700. In this embodiment, the compressible end portion 406 may immediately return to its original shape nearly simultaneously as it is released from the bowstring 700 rather than returning to its original shape after the projectile is launched. The additional acceleration provided by the expansion of the compressible end portion 406 against the bowstring 700 may partially mitigate the loss in velocity of the projectile that is caused by the absorption of energy in compression of the nock.

Figure 7D:
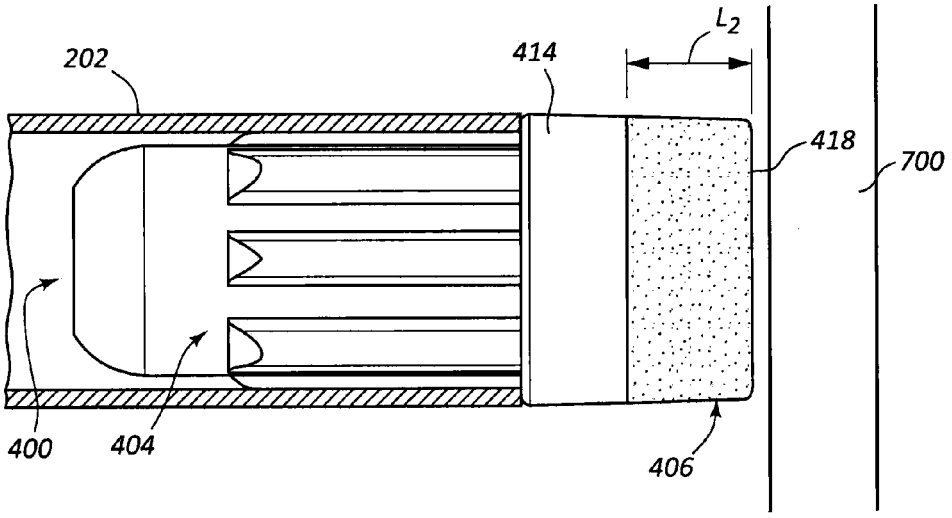
FIG. 7D is a top view of a bowstring and an uncompressed nock according to an embodiment of the present disclosure.
Figure 7E:
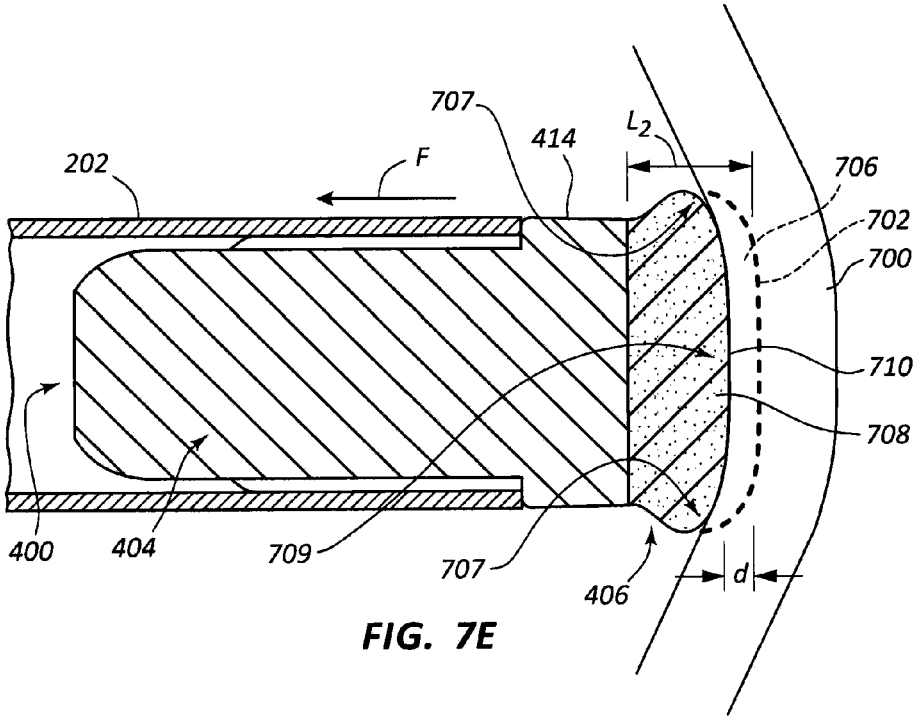
FIG. 7E is a section view of a bowstring and a compressed nock according to an embodiment of the present disclosure taken through section lines 7E-7E in FIG. 7A.

FIGS. 7D-7E show a top view of a compressible nock according to an embodiment of the present disclosure. The length of the bowstring 700 is shown in-plane with these figures. In FIG. 7D, the compressible end portion 406 of the nock 400 is uncompressed. Thus, the compressible end portion 406 has a length $L_2$ across its entire flat rear surface 418. The end portion 406 of the nock 400 may be in an uncompressed state when not in contact with the bowstring 700 or just after being released from the bowstring 700 (e.g., as shown in the embodiment of FIG. 7C).

As shown in the central section view of FIG. 7E (taken through section lines 7E-7E in FIG. 7A), when the bowstring 700 applies a force to the compressible end portion 406, the rear surface 418 may deform, as described above in connection with FIGS. 7A-7B. Thus, the bowstring 700 may compress the rear surface 418 of the compressible end to a depth d. FIG. 7E shows that the compressible end portion 406 may deform laterally along the length of the bowstring 700 and bulge outward. Thus, the diameter or width of the compressible end portion 406 may be larger or wider in this dimension when it is compressed than when it is not compressed. In one embodiment, the diameter or other areas of the rear surface 418 of the compressible end may be reduced in size to compensate for such deformation.

Also, the central rear surface 710 of the compressible end portion 418 that is in contact with the bowstring 700 may deform from a flat surface to an at least partially curved or arcuate profile. Thus, the curve in the central rear surface 710 may be distinguished from the arc 702 of the groove 703 produced by the bowstring 700 that is apparent when viewed from the side of the nock 400 (e.g., in the view of FIG. 7A). The curve of the central rear surface 710 illustrated in FIG. 7E may therefore be referred to as a curve extending along the length of the bowstring or a curve within a plane of motion of the bowstring (e.g., horizontal plane 603).

FIG. 7E also illustrates that the adjacent or lateral sections 704, 706 (only one shown) of the compressible end portion 406 may form around the bowstring 700 when the compressible end portion 406 is deformed. The other adjacent portion 704 would also form around the bowstring 700. The rear surfaces 712 of the adjacent portions 704, 706 may also be deformed into curved or arcuate profiles.

Figure 8:
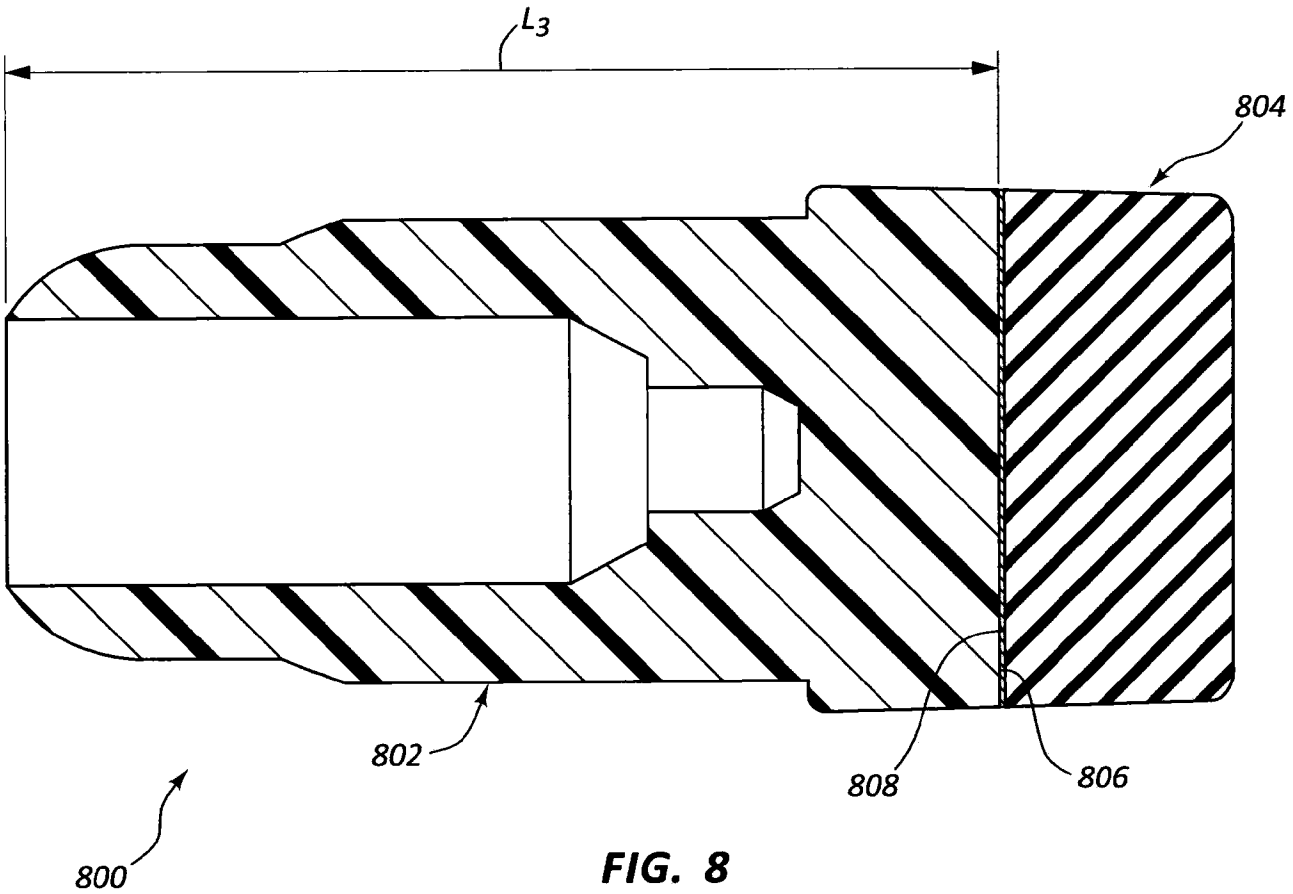
FIG. 8 is a side section view of a nock according to another embodiment of the present disclosure.

FIGS. 8-10C illustrate various alternative embodiments of the compressible nock of the present disclosure. In FIG. 8, the nock 800 comprises a main body portion 802 and a compressible end portion 804. The main body portion 802 is configured with features similar to main body portion 404 discussed elsewhere herein. Compressible end portion 804 may be attached to a flat rear face 806 of the main body portion 802. The compressible end portion 804 may have a flat forward face 808 configured to adhere to the flat rear face 806 across at least a portion of the flat forward face 808. The compressible end portion 804 may therefore not extend into the main body portion 802. The main body portion 802 may be a "flat back" nock found in some conventional crossbow nocks. Thus, manufacturing the nock 800 may entail adding the compressible end portion 804 to the rear face 806 of a conventional flat back nock using an adhesive, clip, tack, or other attachment methods or devices known to those skilled in the art. This may allow an end user to modify existing "flat back" nocks to become compressible nocks such as nock 800.

Figure 9B:
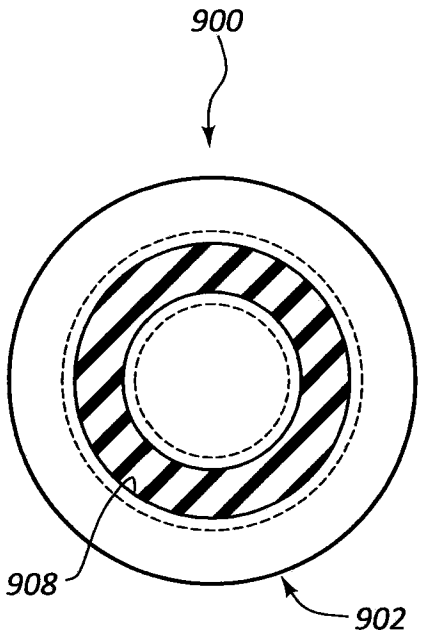
FIG. 9B is an end section view of the nock of FIG. 9A taken through section lines 9B-9B in FIG. 9A.
Figure 9A:
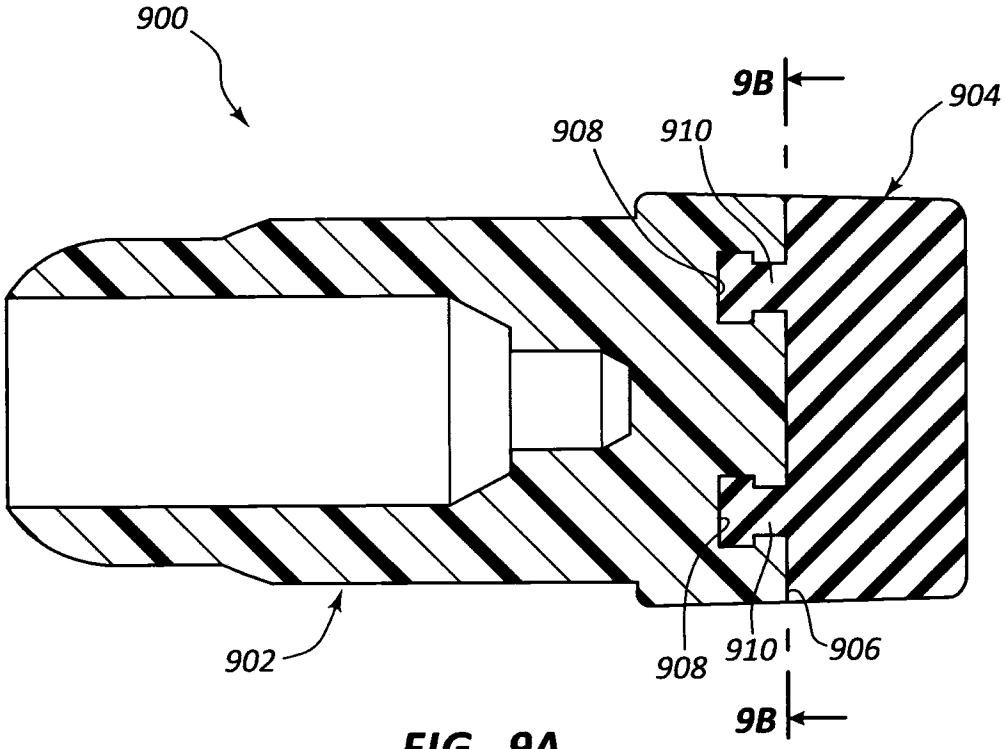
FIG. 9A is a side section view of a nock according to another embodiment of the present disclosure.

FIGS. 9A-9B show another embodiment of a nock 900 according to the present disclosure. FIG. 9A is a central section view of the nock 900, and FIG. 9B is an end-facing section view taken through section lines 9B-9B in FIG. 9A. The nock 900 may comprise a main body portion 902 and a compressible end portion 904 similar to other embodiments described herein. Additionally, the rear face 906 of the main body portion 902 may comprise a groove 908. The groove 908 may be generally circular when viewed from the end of the nock 900, as shown in FIG. 9B, and may have a section profile such as, for example, a T-shape 910 (as shown in FIG. 9A), a semicircle (not shown), a rectangle (not shown), triangular (not shown), or another suitable profile. The compressible end portion 904 may be attached to the rear face 906 at least partially within the groove 908. The groove 908 may be beneficial in increasing the surface area of the rear face 906 that is available for the compressible end portion 904 to contact and adhere to. The end shape of the groove 908 is shown as being circular in FIG. 9B, but other patterns or shapes may be similarly implemented, such as rectangles, triangles, etc.

Figure 10B:
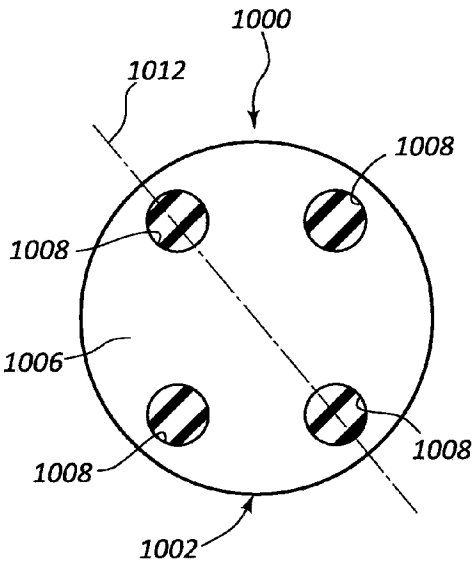
FIG. 10B is an end section view of the nock of FIG. 10A taken through section lines 10B-10B in FIG. 10A.
Figure 10A:
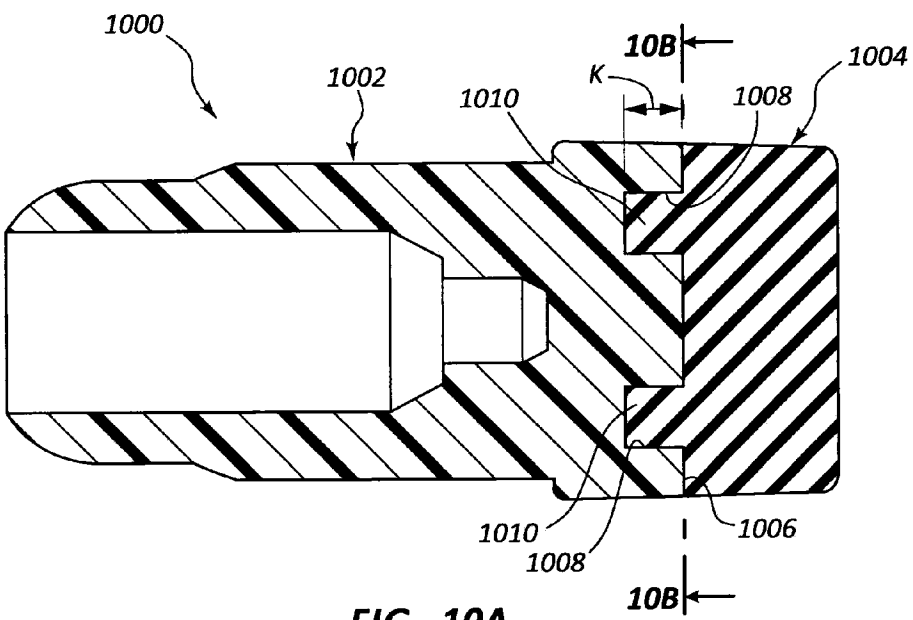
FIG. 10A is a side section view of a nock according to another embodiment of the present disclosure.

FIGS. 10A-10B show another embodiment of a nock 1000 according to the present disclosure. The nock 1000 may comprise a main body portion 1002 and a compressible end portion 1004 comparable to other embodiments described herein. Additionally, the rear face 1006 of the main body portion 1002 may comprise a plurality of cavities 1008. The cavities 1008 may extend to a depth K within the main body portion 1002, as shown in the side section view of FIG. 10A taken centrally through the cavities 1008 along plane 1012 of FIG. 10B.

FIG. 10B is a section view of the nock 1000 taken through section lines 10B-10B in FIG. 10A. The cavities 1008 may be generally cylindrical in shape and may be beneficial by increasing the overall surface area of the rear face 1006 that is available for the compressible end portion 1004 to contact and adhere to. The cavities 1008 may receive protrusions 1010 extending from the compressible end portion 1004. The cavities 1008 may be textured to further enhance the retention of the compressible end portion 1004 to the main body portion 1002. The cavities 1008 and the groove 908 (of FIGS. 9A-9B) may be referred to as internal voids of the body of the nock.

Figure 10C:
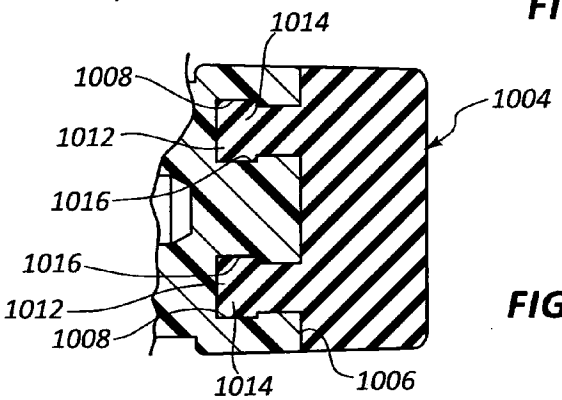
FIG. 10C is a side section view of another nock according to another embodiment of the present disclosure with the section taken through posts in the compressible portion of the nock.

In some embodiments, the cavities 1008 may provide a mechanical lock for the compressible end portion 1004 to attach to the main body portion 1002. The mushroom-shaped protrusions 1012 of FIG. 10C show an example of this feature. The broadened heads 1014 of the protrusions 1012 fit within cavities 1008 having broadened internal voids 1016 in a manner causing mechanical interference that resists removal of the protrusions 1012 from the cavities 1008.

Figure 11A:
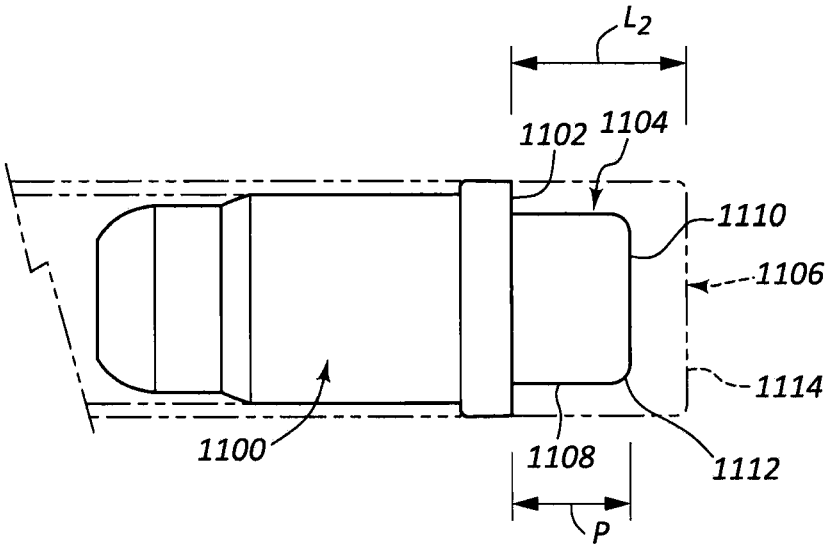
FIGS. 11A, 11B, 11C, and 11D are side views of alternative embodiments of main body portions according to the present disclosure.

FIGS. 11A-11D show additional examples of side views of embodiments of nock main body portions according to the present disclosure. In FIG. 11A, the nock main body portion 1100 comprises an end surface 1102 from which a protrusion 1104 (i.e., a bar, a knob, a post, a projection, or a protuberance) extends. The nock main body portion 1100 is configured to fit at least partially within the shaft of a bolt with the end surface 1102 exposed. The protrusion 1104 extends rearward from the end surface 1102 and may be comprised of a rigid material such as, for example, the same material used to create the rest of the nock main body portion 1100. The protrusion 1104 may be fitted within a compressible end portion 1106. Thus, the compressible end portion 1106 may extend laterally and rearwardly around the protrusion 1104 and may have an internal void at least partially filled by the protrusion 1104. In some embodiments, the compressible end portion 1106 may be molded around external surfaces (e.g., lateral external surface 1108 and rear external surface 1110) of the protrusion 1104. The protrusion 1104 may have a rounded rear edge 1112 or a pointed or squared edge. The protrusion 1104 may be beneficially cylindrical in shape, but in other cases the protrusion 1104 may be a rectangular prism, star-shaped prism, dome, half-moon shape (e.g., the shape of protrusion 1204 in FIG. 12A), or other shape extending into and surrounded by the compressible end portion 1106.

By adding a protrusion 1104 within the compressible end portion 1106, the compressible end portion 1106 may be reinforced to resist lateral deflection and deformation upon compression. Thus, when a bowstring strikes the rear surface 1114 of the compressible end portion 1106, the compressible end portion 1106 may be resistant to allowing the bowstring to translate laterally (i.e., up or down in FIG. 11A) relative to the nock main body portion 1100 while the bowstring remains stationary relative to the rear surface 1114 of the compressible end portion 1106.

Figure 11B:
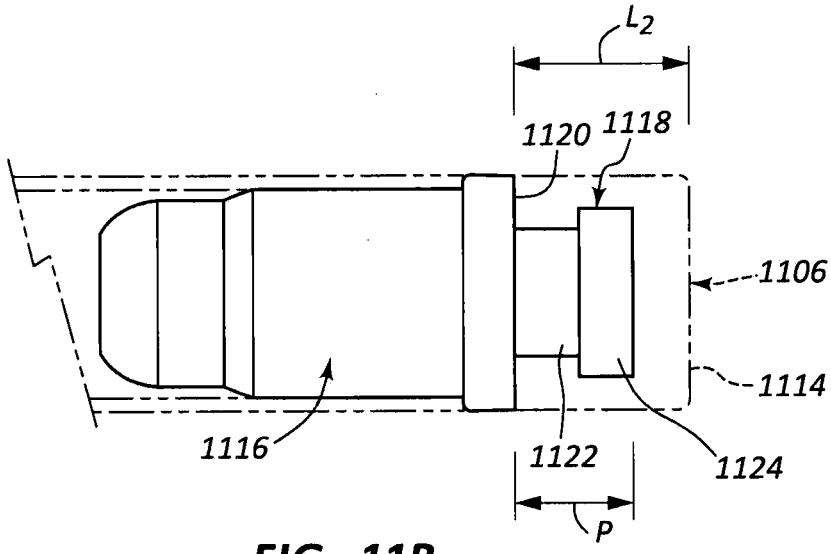

FIG. 11B shows another embodiment of a nock main body portion 1116 with a protrusion 1118 extending from a rear surface 1120. The protrusion 1118 may in this embodiment have a generally T-shaped cross-section since it may comprise a narrow portion 1122 and a broad portion 1124. The narrow portion 1122 and broad portion 1124 may be cylindrical, a rectangular or other polygonal prism, or another shape. In some embodiments, the narrow portion 1122 may have one shape (e.g., cylindrical) and the broad portion 1124 may have another shape (e.g., a spherical shape, dome, star, or half-moon shape (e.g., the shape of protrusion 1204 in FIG. 12A)). By providing a narrow portion 1122 and a broad portion 1124, the retention of the compressible end portion 1106 to the protrusion 1118 may be improved due to the mechanical interference of the broad portion 1124 resisting removal of the compressible end portion 1106 from the broad portion 1124 when the compressible end portion 1106 is pulled rearward.

Figure 11C:
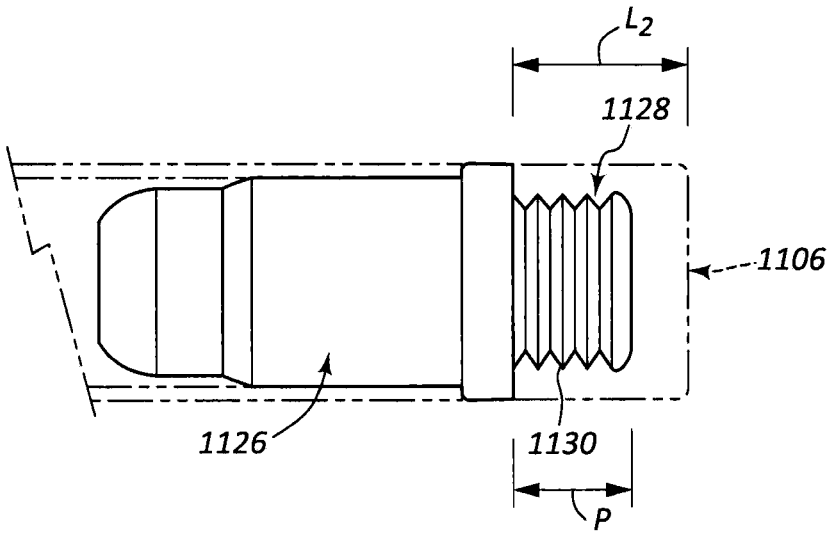

FIG. 11C shows another embodiment of a nock main body portion 1126 wherein the protrusion 1128 has a textured side surface 1130. The textured side surface 1130 may comprise ridges and grooves (as shown), threads, spikes, holes, bumps, or other texturing elements that increase the surface area of the protrusion 1128 and provide mechanical interference that helps prevent the compressible end portion 1106 from being pulled from or sliding off of the protrusion 1128. In FIG. 11C, the protrusion 1128 is generally cylindrical, but it may alternatively be formed with the shapes described in connection with protrusion 1104.

Figure 11D:
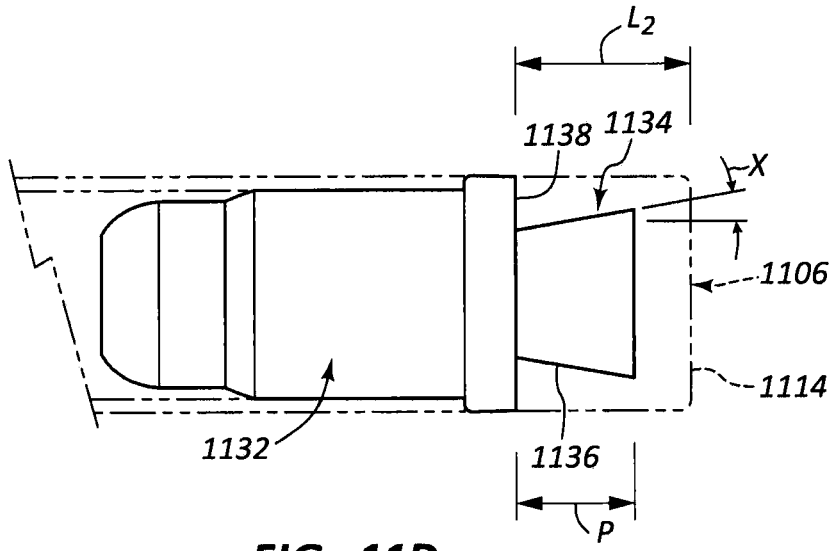

FIG. 11D shows another embodiment of a nock main body portion 1132 wherein the protrusion 1134 has an angled side surface 1136. The angled side surface 1136 may extend away from a rear surface 1138 of the main body portion 1132 at an angle X relative to the longitudinal axis of the main body portion 1132. The angled side surface 1136 may provide a mechanical lock or interference fit for the compressible portion 1106 that resists removal by rearward axial movement of the compressible portion 1106. The angle X may be beneficially between about zero degrees and about 10 degrees to keep the compressible portion 1106 properly attached.

In the embodiments of FIGS. 11A-11D, the length P of the protrusions 1104, 1118, 1128, 1134 is shown being about 60 percent of the length $L_2$ of the compressible end portion 1106. In other embodiments, the length P may be less than half of length $L_2$, such as, for example, between 10 and 30 percent of the length $L_2$. Longer protrusions may provide more rigidity, and shorter protrusions may provide less rigidity but may still be used to resist lateral peeling or slippage of the compressible end portion 1106 from the ends of the nocks.

Figure 12A:
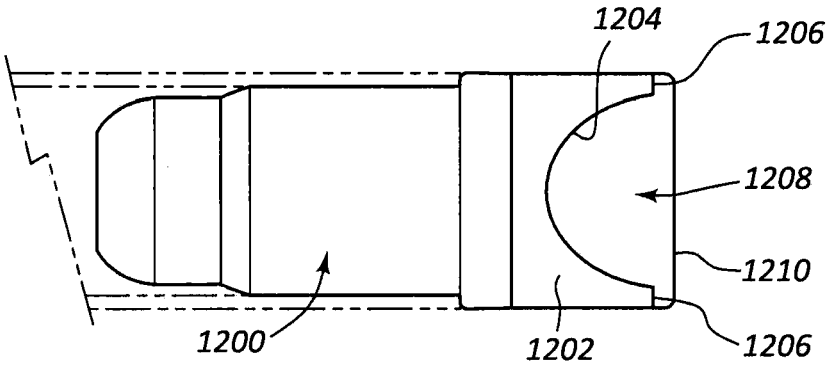
FIGS. 12A and 12B are side views of alternative embodiments of the compressible end portion according to the present disclosure.
Figure 12B:
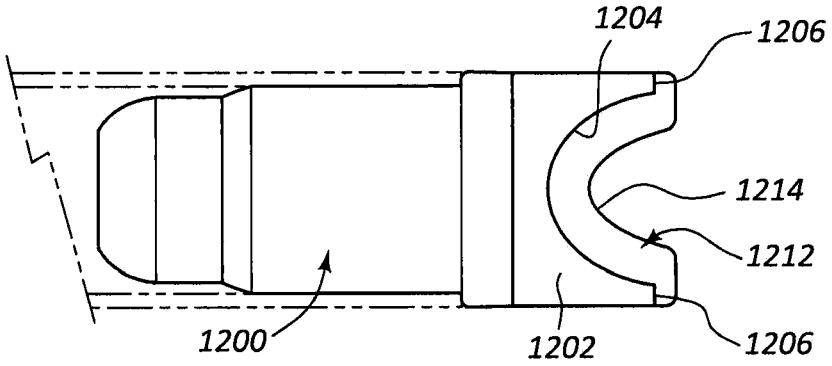

FIGS. 12A-12B show additional embodiments of nocks according to the present disclosure. In these figures, a nock main body portion 1200 may comprise a half-moon- or crescent-shaped rear end 1202 when viewed from the side. The rear end 1202 may comprise a contoured or grooved rear surface 1204 and one or more flat rear surfaces 1206. As shown in FIG. 12A, a compressible end portion 1208 may be formed to completely fill the grooved rear surface 1204 and may also extend rearward from the flat rear surfaces 1206. Thus, compressible end portion 1208 may be compressible from a flat rear surface 1210 to be at least partially surrounded by the grooved rear surface 1204 of the nock main body portion 1200. The bowstring, upon loading a projectile onto the bowstring, may deform the rear surface 1210 and may be at least partially surrounded by the compressible end portion 1208 and by the rear end 1202 of the nock main body portion 1200. In FIG. 12B, the compressible end portion 1212 also forms an arcuate or curved end surface 1214. Thus, a bowstring may be loaded into the groove 1214 when the bolt is launched. The nock may compress and yield to the bowstring to retain the bowstring in the groove 1214 until release, even if the nock is not perfectly aligned.

Figure 13:
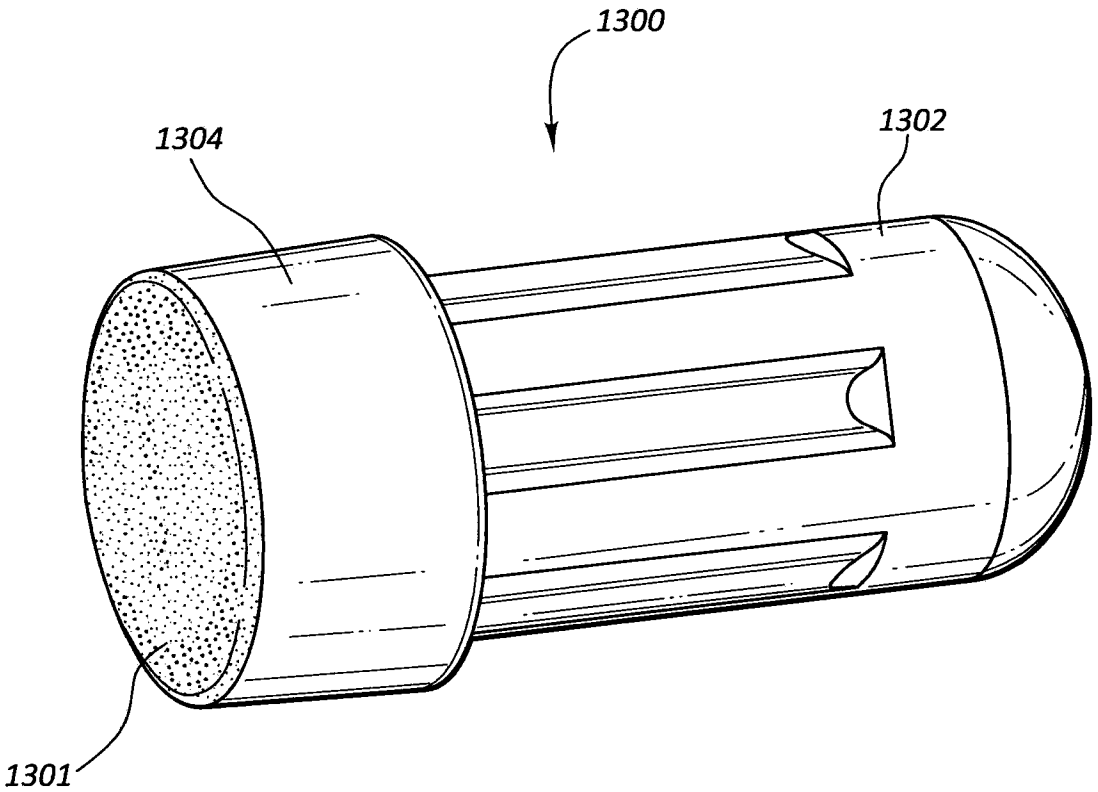
FIG. 13 is a perspective view of another embodiment of a compressible nock according to the present disclosure.

FIG. 13 shows yet another example embodiment of a nock 1300 for an archery arrow or bolt. The nock 1300 in this embodiment has substantially the same outer shape as nocks disclosed herein (e.g., nock 400), but the entire nock 1300 is a single-piece, unitary, continuous block of a compressible material. For example, the entire nock 1300 may be a single piece of molded urethane or TPE. A front end portion 1302 of the nock 1300 may be insertable into a trailing end of a shaft of an arrow or bolt, and a rear end portion 1304 of the nock 1300 may extend rearward from the rear end of the shaft after the nock 1300 is installed. Thus, the front end portion 1302 may not be formed separately from the rear end portion 1304, as with other embodiments described above (e.g., in FIG. 4). Rather, the rear end 1304 may be integral and continuously formed from the main body portion. Thus, not only is the rear end portion 1304 compressible, but the remainder of the nock 1300 may also be compressible. Those skilled in the art will understand, however, that the rear end portion 1304 will interact with the bowstring substantially the same or similar to what is described in connection with FIGS. 7A-7E. When the nock 1300 is installed on a shaft, there may be no intervening structure between the forward end 1302 and the inside of the shaft. Thus, the compressible portion of the nock 1300 may directly contact the interior of the shaft without any additional or intermediary structure between the compressible forward end 1302 and the shaft. Furthermore, to increase the friction or resistance between the bowstring and the end surface of the rear end portion 1304, a textured, pitted, ribbed, cross-hatched, or other roughening structure 1301 may be provided on the flat end surface of the nock.

By using a nock 1300 with uniform and continuous material both inside and outside the shaft, the nock 1300 may be less expensive and/or difficult to manufacture. The rear end 1304 of the nock 1300 may also be less susceptible to being disconnected or removed from a forward end 1302 since both ends are part of the same piece. Thus, this embodiment of a nock 1300 may eliminate the need for additional posts, holes, or other means for connecting a compressible portion to a rigid body portion.

Figure 14B:
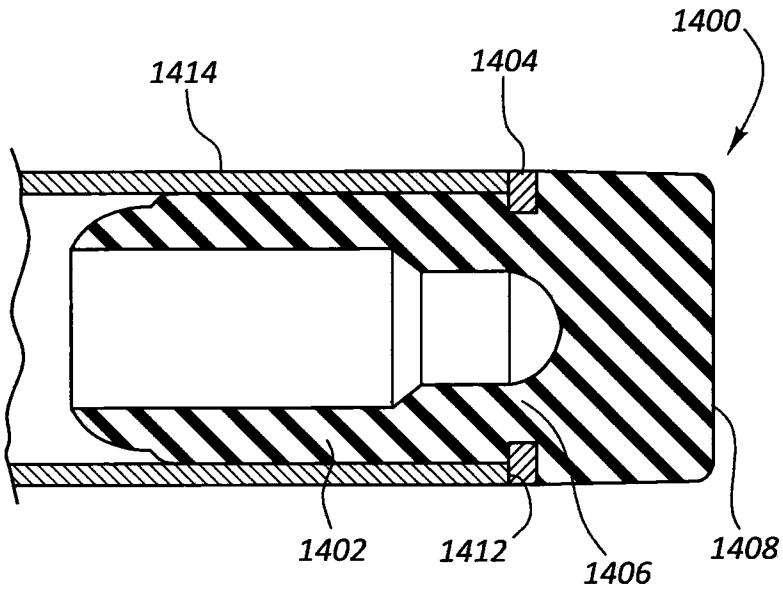
FIG. 14B is a section view of the compressible nock of FIG. 14A.
Figure 14A:
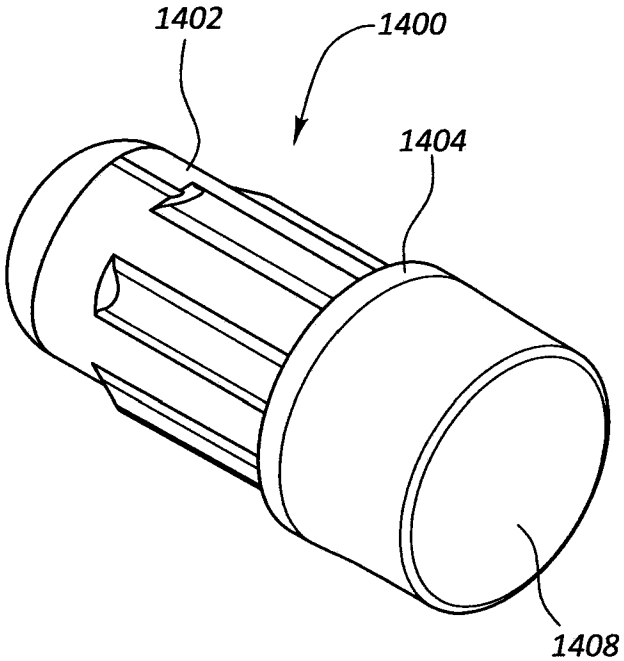
FIG. 14A is a perspective view of another embodiment of a compressible nock according to the present disclosure.

FIGS. 14A-14B depict another embodiment of a compressible nock 1400 wherein the nock 1400 comprises a substantially uniform-material, single-piece, unitary main body 1402 and a structural reinforcing member 1404 (e.g., a washer or other type of generally flat and/or broad spacer). The structural reinforcing member 1404 may be positioned around a midsection 1406 of the main body 1402 between a rear end portion 1408 and a front end portion 1410. Thus, the structural reinforcing member 1404 may be described as being forward of the rear end portion 1408 or between the shaft 1414 of a bolt or arrow and the rear end portion 1408 of the nock 1400. The rear and front end portions 1408, 1410 may be wider in diameter than the midsection 1406 so that the structural reinforcing member 1404 remains in place relative to the rest of the nock 1400. The main body 1402 may be installed in a shaft 1414 of an arrow or bolt with the structural reinforcing member 1404 disposed between the front end portion 1410 and the rear end portion 1408 and positioned to rest against a rear end 1412 of the shaft. See FIG. 14B.

With the structural reinforcing member 1404 in this position, the rear end portion 1408 of the main body 1402 may contact the structural reinforcing member 1404 and compress against the structural reinforcing member 1404 when the rear end portion 1408 is compressed by a bowstring. The structural reinforcing member 1404 has a larger and wider surface area than the rear end 1412 of the shaft, so the compressible rear end portion 1408 may be less prone to shearing or breaking due to contact with the rear end 1412 when it is compressed.

Further embodiments of the present disclosure may comprise methods related to nocking an archery arrow or bolt to a bowstring. An example method may comprise providing an arrow or bolt that has a compressible rear surface (e.g., a compressible end portion 406) and a bow or crossbow having a string (e.g., bowstring 120), loading the projectile (e.g., an arrow or bolt) on to the bow or crossbow by positioning the projectile forward of the bowstring (e.g., in a launching position), wherein the compressible rear surface is configured to contact the bowstring upon release of the bowstring and release of tension in the limbs (e.g., limbs 118).

Next, this method may comprise applying a force against the compressible rear surface of the arrow or bolt with the bowstring (e.g., by releasing the bowstring), thereby compressing the compressible rear surface to form a groove in the compressible rear surface where it contacts the bowstring. This groove may be a groove 703 discussed above which may be configured to dynamically retain the bowstring upon release of the bowstring. The groove may dynamically grip the surface of the bowstring, meaning that some surfaces of the bowstring may be held in contact with the rear surface of the nock dynamically and temporarily while the arrow or bolt is launched, but these surfaces may not contact the rear surface of the nock when the arrow or bolt is at rest or as the arrow or bolt is released from the bowstring.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A projectile having a compressible nock, the projectile comprising:

a shaft having a front end portion and a rear end portion, the shaft having a longitudinal axis, the shaft being positionable in a wide range of rotational positions;

an arrow point positioned on the front end portion of the shaft;

a plurality of vanes extending from the shaft between the front end portion and the rear end portion;

a nock at least partially extending from the rear end portion of the shaft, the nock comprising a compressible end portion, the compressible end portion being compressible in an axial direction coincident with the longitudinal axis of the shaft irrespective of the rotational position of the shaft to maintain the nock on a bowstring when launching the projectile.

2. The projectile of claim 1, wherein the nock comprises a main body portion separate from the compressible end portion, the main body portion being attachable to the rear end portion of the shaft, the main body portion having a rear end surface, wherein the compressible end portion is attached to the rear end surface of the main body portion.

3. The projectile of claim 2, wherein the rear end surface of the main body portion comprises a groove or hole, the compressible end portion at least partially extending into the groove or hole.

4. The projectile of claim 1, wherein the nock comprises a main body portion separate from the compressible end portion, the main body portion being attachable to the rear end portion of the shaft, wherein the compressible end portion of the nock is attached to the main body portion by an interference fit or a friction fit.

5. The projectile of claim 1, wherein the compressible end portion comprises a rear surface, the rear surface being substantially flat when the compressible end portion is uncompressed and being contoured when the compressible end portion is compressed between a bowstring and the shaft.

6. The projectile of claim 1, wherein the projectile is a crossbow bolt.

7. The projectile of claim 1, wherein the compressible end portion comprises a rear surface, the rear surface being compressible into a half-moon shape.

8. The projectile of claim 1, wherein the compressible end portion is compressible into an outer shape of a bowstring as a result of contact with the outer shape of the bowstring.

9. The projectile of claim 1, wherein the compressible end portion has an end diameter substantially equal to a shaft diameter of the shaft.

10. The projectile of claim 1, wherein the nock comprises a front end portion inserted into the shaft, wherein the front end portion and the compressible end portion are a single piece.

11. The projectile of claim 1, wherein a structural reinforcing member is positioned forward of the compressible end portion.

12. A flexible nock for an archery arrow or bolt, the flexible nock comprising:

a front end portion configured to be inserted into an arrow or bolt, the front end portion having a longitudinal axis;

a rear end portion configured to extend rearward from the arrow or bolt upon insertion of the front end portion into the arrow or bolt, the rear end portion being configured to at least partially deform toward the front end portion irrespective of a rotational position of the nock upon application of a force against the rear end portion in an axial direction that coincides with the longitudinal axis of the front end portion to maintain the nock on a bowstring when launching the arrow or bolt.

13. The flexible nock of claim 12, wherein the front end portion is a separate part from the rear end portion, and the front end portion is substantially rigid.

14. The flexible nock of claim 13, wherein the front end portion further comprises an internal void, the rear end portion extending at least partially into the internal void.

15. The flexible nock of claim 14, wherein the internal void comprises a narrow portion and a broader portion and the rear end portion is retained within the internal void through the narrow and the broader portions.

16. The flexible nock of claim 13, wherein the rear end portion extends at least partially into the front end portion.

17. The flexible nock of claim 13, wherein a rear surface of the front end portion comprises a hole or a groove.

18. The flexible nock of claim 12, wherein at least part of the rear end portion has a Shore A hardness within in a range of about 20 to about 100.

19. The flexible nock of claim 12, wherein at least part of the rear end portion has a Shore A harness within a range of about 65 to about 80.

20. The flexible nock of claim 12, wherein the rear end portion is configured to grip a bowstring upon the bowstring applying pressure to the rear end portion member toward the front end portion.

21. The flexible nock of claim 12, wherein a rear surface of the rear end portion is configured to at least partially deform into an arc upon application of a force by a bowstring.

22. The flexible nock of claim 21, wherein the arc has a radius substantially equal to a bowstring radius of the bowstring.

23. The flexible nock of claim 12, wherein the rear end portion comprises a textured surface.

24. The flexible nock of claim 12, wherein the front end portion and rear end portion are a unitary block of a compressible material.

25. A method of nocking an archery arrow or bolt to a bowstring, the method comprising:

providing an arrow or bolt having a compressible rear surface and a plurality of vanes and providing a bow or crossbow having a bowstring;

loading the arrow or bolt in the bow or crossbow by positioning the arrow or bolt forward of the bowstring, wherein the compressible rear surface is configured to contact the bowstring upon release;

applying a force against the compressible rear surface of the arrow or bolt with the bowstring, wherein the force compresses the compressible rear surface to form a groove in the compressible rear surface where the compressible rear surface contacts the bowstring; wherein the groove is formed in the compressible rear surface to maintain the nock on the bowstring when launching the arrow or bolt irrespective of the rotated position of the plurality of vanes relative to the bow or crossbow.

26. The method of claim 25, wherein the groove dynamically grips a surface of the bowstring upon release of the bowstring.

27. The method of claim 25, wherein the groove is positioned between two ridges extending parallel to the bowstring.

28. The method of claim 25, wherein the bowstring comprises a bowstring radius and the bowstring compresses the compressible rear surface to a depth less than the bowstring radius.

29. The method of claim 25, wherein the bowstring compresses the compressible rear surface to form an at least temporarily asymmetric groove.

30. A projectile having a compressible nock, the projectile comprising:

a shaft having a front end portion and a rear end portion, the shaft having a longitudinal axis;

an arrow point positioned on the front end portion of the shaft;

a plurality of vanes extending from the shaft between the front end portion and the rear end portion;

a nock at least partially extending from the rear end portion of the shaft, the nock comprising a compressible end portion, the compressible end portion being compressible in an axial direction coincident with the longitudinal axis of the shaft to maintain the nock on a bowstring when launching the projectile, the compressible end portion comprising a rear surface, the rear surface being substantially flat when the compressible end portion is uncompressed and being contoured when the compressible end portion is compressed between a bowstring and the shaft.

31. A flexible nock for an archery arrow or bolt, the flexible nock comprising:

a front end portion configured to be inserted into an arrow or bolt, the front end portion having a longitudinal axis and being substantially rigid;

a rear end portion configured to extend rearward from the arrow or bolt upon insertion of the front end portion into the arrow or bolt, the rear end portion being configured to at least partially deform toward the front end portion upon application of a force against the rear end portion in an axial direction that coincides with the longitudinal axis of the front end portion;

wherein the front end portion is a separate part from the rear end portion;

wherein the front end portion further comprises an internal void, the rear end portion extending at least partially into the internal void, wherein the internal void comprises a narrow portion and a broader portion and the rear end portion is retained within the internal void through the narrow and the broader portions.

32. A method of nocking an archery arrow or bolt to a bowstring, the method comprising:

providing an arrow or bolt having a compressible rear surface and a bow or crossbow having a bowstring;

loading the arrow or bolt in the bow or crossbow by positioning the arrow or bolt forward of the bowstring, wherein the compressible rear surface is configured to contact the bowstring upon release;

applying a force against the compressible rear surface of the arrow or bolt with the bowstring, wherein the force compresses the compressible rear surface to form an at least temporarily asymmetric groove in the compressible rear surface where the compressible rear surface contacts the bowstring.

* * * * *